US011125086B2

(12) United States Patent
Ishida et al.

(10) Patent No.: US 11,125,086 B2
(45) Date of Patent: Sep. 21, 2021

(54) ROTOR BLADE AND AXIAL FLOW ROTATING MACHINE WITH THE SAME

(71) Applicant: MITSUBISHI HEAVY INDUSTRIES, LTD., Tokyo (JP)

(72) Inventors: Tomohiro Ishida, Tokyo (JP); Toshifumi Kanno, Tokyo (JP); Hikaru Kurosaki, Tokyo (JP); Eisaku Ito, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 16/787,210

(22) Filed: Feb. 11, 2020

(65) Prior Publication Data

US 2021/0102467 A1 Apr. 8, 2021

(30) Foreign Application Priority Data

Oct. 4, 2019 (JP) ..... JP2019-183798

(51) Int. Cl.
*F01D 5/22* (2006.01)
*F01D 5/20* (2006.01)

(52) U.S. Cl.
CPC ..... *F01D 5/225* (2013.01); *F01D 5/20* (2013.01); *F05D 2250/185* (2013.01)

(58) Field of Classification Search
CPC ..... F01D 5/225; F01D 5/20; F05D 2250/185
USPC ..... 415/173.1; 416/191
See application file for complete search history.

(56) References Cited

U.S. PATENT DOCUMENTS

| | | | | |
|---|---|---|---|---|
| 7,063,509 | B2 * | 6/2006 | Snook | F01D 5/141 416/189 |
| 8,801,371 | B2 * | 8/2014 | Kreiselmaier | F01D 11/10 415/173.1 |
| 8,807,928 | B2 * | 8/2014 | Kareff | F01D 5/143 415/173.6 |
| 2008/0038116 | A1 | 2/2008 | Zemitis et al. | |
| 2013/0259691 | A1 * | 10/2013 | Liu | F01D 5/225 416/179 |

FOREIGN PATENT DOCUMENTS

JP 2008-38910 2/2008

* cited by examiner

*Primary Examiner* — Mahmoud Gimie
(74) *Attorney, Agent, or Firm* — Wenderoth, Lind & Ponack, L.L.P.

(57) ABSTRACT

A rotor blade includes a blade body which has an airfoil shape and a shroud 57 which is formed in an end portion of the blade body. The shroud includes a shroud cover and a seal fin which protrudes from the shroud cover toward a radial outside and extends in a direction having a direction component in a circumferential direction. A front end of the seal fin extends in the circumferential direction and a base end of the seal fin extends in a direction having a direction component in the circumferential direction. A part of the seal fin in the circumferential direction forms a shift portion. An axial center position of a base end of the shift portion is different from an axial center position of a front end of the shift portion in the axial direction.

11 Claims, 15 Drawing Sheets

ROTOR BLADE AND AXIAL FLOW ROTATING MACHINE WITH THE SAME

BACKGROUND OF THE INVENTION

Field of the Invention

The present invention relates to a rotor blade and an axial flow rotating machine with the same.

The present application claims the priority of Japanese Patent Application No. 2019-183798 filed on Oct. 4, 2019 and incorporates the contents thereof individually.

Description of Related Art

A gas turbine which is a kind of axial flow rotating machine includes a rotor which rotates about an axis and a casing which covers the rotor. The rotor includes a rotor shaft and a plurality of rotor blades which are attached to the rotor shaft.

For example, the rotor blade of Patent Document below includes a blade body which has an airfoil shape, a shroud, and a platform. The blade body extends in a radial direction with respect to an axis. Thus, a blade height direction of the blade body is the radial direction. The shroud is provided in an end on a radial outside of the blade body. The platform is provided in an end on a radial inside of the blade body. All of the shroud and the platform extend in a direction substantially perpendicular to the radial direction. The shroud includes a shroud main body (or a shroud cover) and a seal fin. The shroud main body includes a gas path surface which faces the radially inward side, and a back surface which is opposite to the gas path surface and which faces the radially outward side. The seal fin protrudes from the back surface of the shroud main body toward the radially outward side D and extends in the circumferential direction with respect to the axis.

Patent Document 1: Japanese Unexamined Patent Application, First Publication No. 2008-038910

SUMMARY OF THE INVENTION

As described above, the shroud is provided in an end on the radially outward side of the blade body. For this reason, an increase in weight of the shroud leads to an increase in centrifugal load applied to the blade body. Thus, it is preferable to decrease the centrifugal load applied to the blade body by decreasing the weight of the shroud.

Here, an object of the present invention is to provide a technique capable of improving durability of a shroud cover while suppressing an increase in weight of a shroud.

A rotor blade of an aspect according to the present invention for achieving the above-described object is a rotor blade attached to a rotor shaft about an axis, including: a blade body which extends in a radial direction with respect to the axis and of which a cross-section orthogonal to the radial direction is formed in an airfoil shape; and a shroud which is formed in an end portion of the blade body on a radial outside with respect to the axis. The shroud includes a shroud cover which extends in a direction having a direction component of a circumferential direction with respect to the axis from each of a pressure surface and a suction surface of the blade body and a seal fin which protrudes from the shroud cover toward the radially outward side and extends in a direction having a direction component of a circumferential direction. The shroud cover includes a gas path surface which faces a radial inside with respect to the axis, and a back surface which is opposite to the gas path surface and which faces a radial outside. The seal fin includes a base end which has a thickness in an axial direction, in which the axis extends, and intersects the back surface and a front end which has a thickness in the axial direction and is on the most radial outside. The front end extends in the circumferential direction and the base end extends in a direction having a direction component of the circumferential direction. A part of the seal fin in the circumferential direction constitutes a shift portion. An axial center position of the base end of the shift portion is different from an axial center position of the front end of the shift portion in the axial direction.

There is a case in which large moment directed toward the radially outward side is applied to a part of the shroud cover due to the influence of the centrifugal force in accordance with the rotation of the rotor shaft or the influence from other facing rotor blades in the circumferential direction or the like. In this case, a part of them will be deformed toward the radially outward side with respect to the other part. As a method of suppressing the deformation, a method of thickening the thickness of the shroud cover or a method of thickening the thickness from the base end to the front end of the seal fin is considered.

In this aspect, since the base end of the shift portion of the seal fin exists in the vicinity of the portion receiving large moment directed toward the radially outward side in the shroud cover, it is possible to suppress the deformation of the part that receives large moment directed toward the radially outward side in the shroud cover with respect to the other part. Further, in this aspect, the base end is located in the vicinity of the part that receives large moment directed toward the radially outward side by shifting the base end of the seal fin toward the axial direction in relation to the front end without adopting a method of thickening the thickness of the shroud cover or a method of thickening the thickness from the base end to the front end of the seal fin. Thus, in this aspect, it is possible to suppress the deformation of the shroud cover while suppressing an increase in weight of the shroud.

Here, in the rotor blade of the above-described aspect, the shift portion of the seal fin may include an inclined portion which faces the axial direction as it goes toward the radially inward side.

In the rotor blade of any one of the above-described aspects, the seal fin includes a front surface which faces an axial upstream side corresponding to a side where a leading edge exists with respect to a trailing edge of the blade body in the axial direction and a rear surface which faces an axial downstream side opposite to the axial upstream side in the axial direction. The front end includes a forward front end which is an end on the most radial outside in the front surface and a backward front end which is an end on the most radial outside in the rear surface. The base end includes a forward base end which intersects the back surface in the front surface and a backward base end which intersects the back surface in the rear surface. In this case, the forward base end of the shift portion may be shifted toward one side of the axial upstream side and the axial downstream side with respect to the forward front end of the shift portion of the seal fin and the backward base end of the shift portion may be also shifted toward the one side with respect to the backward front end of the shift portion of the seal fin.

In this aspect, since it is possible to suppress the thickness of the base end of the shift portion in the axial direction, it is possible to suppress an increase in weight of the shroud.

Further, in the rotor blade of any one of the above-described aspects, the seal fin includes a front surface which faces an axial upstream side corresponding to a side where a leading edge exists with respect to a trailing edge of the blade body in the axial direction and a rear surface which faces an axial downstream side opposite to the axial upstream side in the axial direction. The front end includes a forward front end which is an end on the most radial outside in the front surface and a backward front end which is an end on the most radial outside in the rear surface. The base end includes a forward base end which intersects the back surface in the front surface and a backward base end which intersects the back surface in the rear surface. In this case, the forward base end of the shift portion may be shifted toward one side of the axial upstream side and the axial downstream side with respect to the forward front end of the shift portion of the seal fin and the backward base end of the shift portion may be shifted toward the other side of the axial upstream side and the axial downstream side with respect to the backward front end of the shift portion of the seal fin.

In this aspect, it is possible to reduce stress generated in the base end and to further suppress the deformation of the shroud cover.

In the rotor blade of any one of the above-described aspects, a thickness of the front end in the axial direction and a thickness of the base end in the axial direction may be thicker than a thickness of an intermediate portion between the front end and the base end of the seal fin in the axial direction.

In the rotor blade of any one of the above-described aspects, the seal fin may extend from a first outer edge corresponding to a part of an outer edge of the back surface to a second outer edge corresponding to another part of the outer edge of the back surface over a camber line of the blade body. In this case, the seal fin includes a first end portion which protrudes from the first outer edge toward the radially outward side and a second end portion which protrudes from the second outer edge toward the radially outward side.

In the rotor blade of the above-described aspect in which the seal fin includes the first end portion and the second end portion, a center position of the base end in the axial direction may match a center position of the front end in the axial direction in the first end portion and the second end portion of the seal fin.

In the rotor blade of any one of the above-described aspects in which the seal fin includes the first end portion and the second end portion, the shift portion may include a pressure side shift portion and a suction side shift portion. In this case, the pressure side shift portion is located on a pressure side in which the pressure surface exists with respect to the camber line. Further, the suction side shift portion is located on a suction side in which the suction surface exists with respect to the camber line. A center position of the base end of the pressure side shift portion in the axial direction is shifted toward the axial upstream side with respect to a center position of the front end of the pressure side shift portion in the axial direction. A center position of the base end of the suction side shift portion in the axial direction is shifted toward an axial downstream side with respect to a center position of the front end of the suction side shift portion in the axial direction. The axial upstream side is a side where a leading edge exists with respect to a trailing edge of the blade body in the axial direction. The axial upstream side is a side opposite to the axial upstream side in the axial direction.

In the shroud cover, the edge on the forward rotation side in the circumferential direction and the edge on the backward rotation side in the circumferential direction contact the other shroud cover adjacent in the circumferential direction. A load directed toward the radially outward side is applied to the edge on the forward rotation side in the shroud cover due to a centrifugal force. A distance between the camber line and the portion on the axial upstream side in relation to the seal fin in the edge on the forward rotation side is larger than a distance between the camber line and the portion on the axial downstream side in relation to the seal fin in the edge on the forward rotation side. For this reason, the moment based on the camber line applied to a portion on the axial upstream side in relation to the seal fin in the edge on the forward rotation side is larger than the moment based on the camber line applied to a portion on the axial downstream side in relation to the seal fin in the edge on the forward rotation side. For this reason, large moment directed toward the radially outward side is applied to a portion on the axial upstream side in relation to the seal fin in the edge on the forward rotation side.

Further, a load directed toward the radially outward side is also applied to the edge on the backward rotation side in the shroud cover due to a centrifugal force. A distance from the camber line and the portion on the axial downstream side in relation to the seal fin in the edge on the backward rotation side is larger than a distance between the camber line and the portion on the axial upstream side in relation to the seal fin in the edge on the backward rotation side. For this reason, the moment based on the camber line applied to a portion on the axial downstream side in relation to the seal fin in the edge on the backward rotation side is larger than the moment based on the camber line applied to a portion on the axial upstream side in relation to the seal fin in the edge on the backward rotation side. For this reason, large moment directed toward the radially outward side is applied to a portion on the axial downstream side in relation to the seal fin in the edge on the backward rotation side.

As described above, when large moment directed toward the radially outward side is applied to a part of the shroud cover, this part will be deformed toward the radially outward side with respect to the other part. In this aspect, the base end of the shift portion of the seal fin exists in the vicinity of the part that receives large moment directed toward the radially outward side in the shroud cover. Thus, in this aspect, it is possible to suppress the deformation of the shroud cover while suppressing an increase in weight of the shroud.

In the rotor blade of any one of the above-described aspects in which the seal fin includes the first end portion and the second end portion, the gas path surface may include a fillet surface which gradually extends toward the radially outward side as it separates away from each of the pressure surface and the suction surface of the blade body in a cross-section orthogonal to the camber line. Further, the back surface may include a recessed surface which extends so as to be recessed toward the radially inward side along the fillet surface in the cross-section. In this case, a height of the seal fin in the radial direction may be set such that the height of an intermediate portion between the first end portion and the second end portion is higher than the height of the first end portion and the height of the second end portion in the seal fin.

In the rotor blade of any one of the above-described aspects, the gas path surface may include a fillet surface which gradually extends toward the radially outward side in a direction in which it separates away from each of the pressure surface and the suction surface of the blade body in a cross-section orthogonal to a camber line of the blade body. Further, the back surface may include a recessed surface which extends so as to be recessed toward the radially inward side along the fillet surface in the cross-section.

Stress is generated in a base portion of the shroud cover with respect to the blade body. As a method of reducing the stress, a method of increasing the curvature radius of the fillet surface is known. The recessed surface of this aspect extends so as to be recessed toward the radially inward side along the fillet surface in the gas path surface. For this reason, in this aspect, the cover thickness which is a distance between the gas path surface and the back surface is not thickened even when the curvature radius of the fillet surface is large. Thus, in this aspect, it is possible to reduce the weight of the shroud cover while reducing the stress generated in the base portion of the shroud cover with respect to the blade body.

In the rotor blade of any one of the above-described aspects including the recessed surface, the recessed surface may extend toward both sides with respect to the camber line in the cross-section. In this case, in the cross-section, a first surface on a pressure side in which the pressure surface exists with respect to the camber line in the recessed surface faces the radially inward side as it goes toward a suction side in which the suction surface exists with respect to the camber line, and a second surface on the suction side with respect to the camber line in the recessed surface faces the radially inward side as it goes toward the pressure side.

In this aspect, since the recessed surface extends toward both sides with respect to the camber line, it is possible to further reduce the weight of the shroud cover.

An axial flow rotating machine of an aspect according to the present invention for achieving the above-described object includes: the plurality of rotor blades of the above-described aspect; the rotor shaft; and a casing. The plurality of rotor blades are arranged in the circumferential direction and are attached to the rotor shaft. The casing covers an outer peripheral side of the rotor shaft and the plurality of rotor blades.

According to an aspect of the present invention, it is possible to improve the durability of the shroud cover while suppressing an increase in weight of the shroud.

DETAILED DESCRIPTION OF THE INVENTION

Hereinafter, various embodiments and modified examples of the present invention will be described with reference to the drawings.

"Embodiments of axial flow rotating machine"

Figure 1:
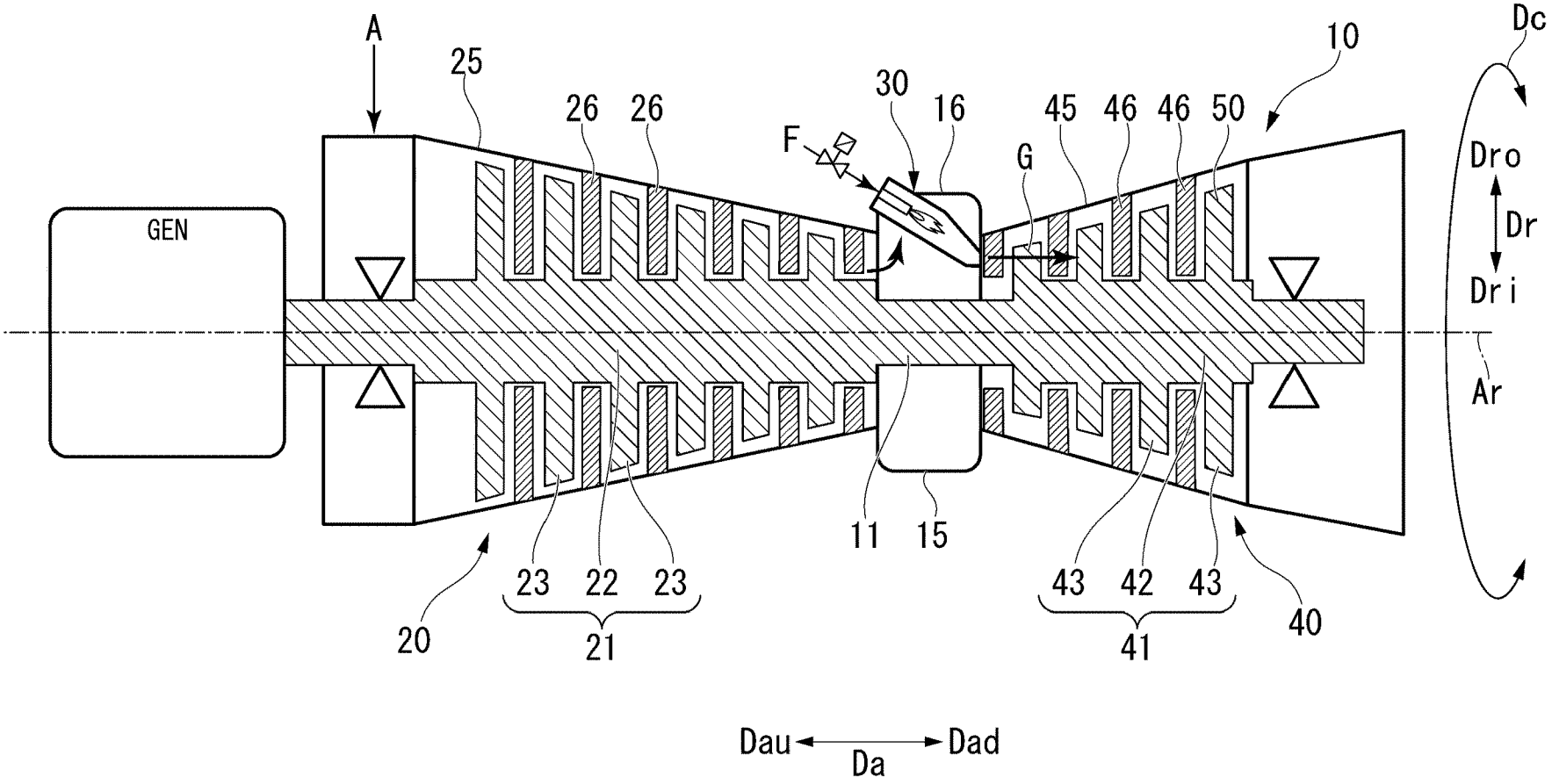
FIG. 1 is a schematic cross-sectional view of a gas turbine according to an embodiment of the present invention.

An embodiment of an axial flow rotating machine according to the present invention will be described with reference to FIG. 1.

An axial flow rotating machine of the embodiment is a gas turbine 10. A gas turbine 10 includes a compressor 20 which compresses air A, a combustor 30 which generates a combustion gas G by burning fuel F in air A compressed by the compressor 20, and a turbine 40 which is driven by the combustion gas G.

The compressor 20 includes a compressor rotor 21 which rotates about an axis Ar, a compressor casing 25 which covers the compressor rotor 21, and a plurality of stationary blade rows 26. The turbine 40 includes a turbine rotor 41 which rotates about an axis Ar, a turbine casing 45 which covers the turbine rotor 41, and a plurality of stationary blade rows 46. Additionally, hereinafter, an extending direction of the axis Ar is referred to as an axial direction Da, a circumferential direction about the axis Ar is simply referred to as a circumferential direction Dc, and a direction perpendicular to the axis Ar is referred to as a radial direction Dr. Further, one side in the axial direction Da is referred to as an axial upstream side Dau and the opposite side is referred to as an axial downstream side Dad. Further, a side closer to the axis Ar in the radial direction Dr is referred to as a radial inside Dri and the opposite side thereof is referred to as a radial outside Dro.

The compressor 20 is disposed on the axial upstream side Dau with respect to the turbine 40. The compressor rotor 21 and the turbine rotor 41 are located on the same axis Ar and are connected to each other so as to constitute a gas turbine rotor 11. For example, a rotor of a generator GEN is connected to the gas turbine rotor 11. The gas turbine 10 further includes an intermediate casing 14 which is disposed between the compressor casing 25 and the turbine casing 45. The combustor 30 is attached to the intermediate casing 14.

The compressor casing 25, the intermediate casing 14, and the turbine casing 45 are connected to each other so as to constitute a gas turbine casing 15.

The compressor rotor 21 includes a rotor shaft 22 which extends in the axial direction Da about the axis Ar and a plurality of rotor blades rows 23 which are attached to the rotor shaft 22. The plurality of rotor blades rows 23 are arranged in the axial direction Da. Each rotor blade row 23 includes a plurality of rotor blades arranged in the circumferential direction Dc. Any one stationary blade row 26 of the plurality of stationary blade rows 26 is disposed on each axial downstream side Dad of the plurality of rotor blades rows 23. Each stationary blade row 26 is provided on the inside of the compressor casing 25. Each stationary blade row 26 includes a plurality of stationary blades arranged in the circumferential direction Dc.

The turbine rotor 41 includes a rotor shaft 42 which extends in the axial direction Da about the axis Ar and a plurality of rotor blades rows 43 which are attached to the rotor shaft 42. The plurality of rotor blades rows 43 are arranged in the axial direction Da. Each rotor blade row 43 includes a plurality of rotor blades 50 arranged in the circumferential direction Dc. Any one stationary blade row 46 of the plurality of stationary blade rows 46 is disposed on each axial upstream side Dau of the plurality of rotor blades rows 43. Each stationary blade row 46 is provided inside the turbine casing 45. Each stationary blade row 46 includes a plurality of stationary blades arranged in the circumferential direction Dc.

The compressor 20 sucks the air A and compresses the air. Compressed air, that is, compression air flows into the combustor 30 through the intermediate casing 14. The fuel F is supplied from the outside into the combustor 30. The combustor 30 generates the combustion gas G by burning the fuel F in the compression air. The combustion gas G flows into the turbine casing 45 and rotates the turbine rotor 41. The generator GEN generates electric power by the rotation of the turbine rotor 41.

Hereinafter, various embodiments of the above-described rotor blade will be described.

"First embodiment of rotor blade"

Referring to FIGS. 2 to 6, a rotor blade according to a first embodiment of the present invention will be described.

Figure 2:
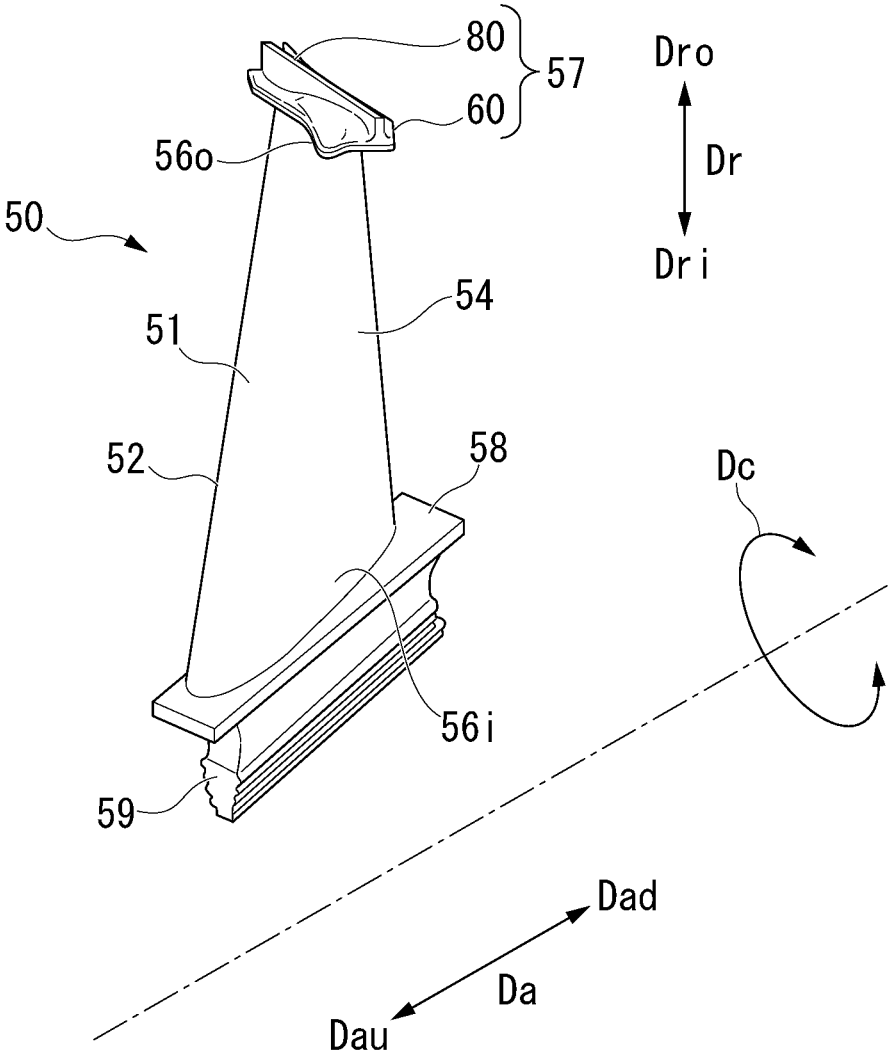
FIG. 2 is a perspective view of a rotor blade according to a first embodiment of the present invention.

The rotor blade 50 of the embodiment includes, as shown in FIG. 2, a blade body 51 which has an airfoil shape, a shroud 57, a platform 58, and a blade base 59. The blade body 51 extends in the radial direction Dr. The cross-section of the blade body 51 is formed in an airfoil shape. Additionally, this cross-section is a cross-section of the blade body 51 perpendicular to the radial direction Dr. The shroud 57 is provided in an outer end portion 56*o* which is an end portion on the radially outward side Dro of the blade body 51. The platform 58 is provided in an inner end portion 56*i* which is an end portion on the radially inward side Dri of the blade body 51. The blade base 59 is provided on the radially inward side Dri of the platform 58.

The platform 58 extends in a direction having a direction component perpendicular to the radial direction Dr. The blade base 59 is a structure for attaching the rotor blade 50 to the rotor shaft 42.

The shroud 57 includes a shroud cover 60 and a seal fin 80. The shroud cover 60 extends in a direction having a direction component perpendicular to the radial direction Dr. The seal fin 80 is provided on the radially outward side Dro of the shroud cover 60.

Figure 3:
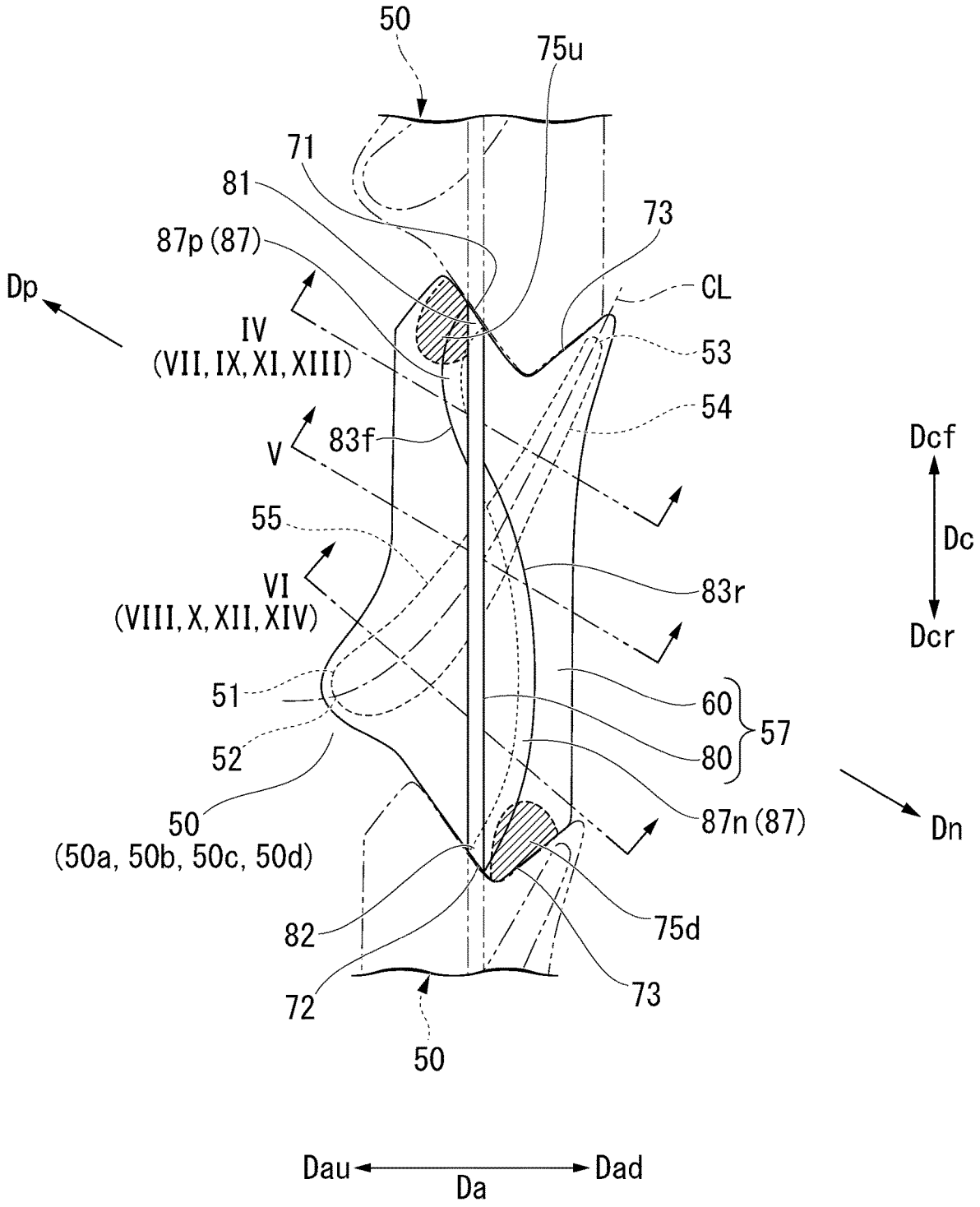
FIG. 3 is a diagram showing the rotor blade according to the first embodiment of the present invention when viewed from the outside in the radial direction.

The blade body 51 includes, as shown in FIGS. 2 and 3, a leading edge 52, a trailing edge 53, a suction surface (dorsal surface) 54 which is a raised surface, and a pressure surface (ventral surface) 55 which is a recessed surface. The leading edge 52 and the trailing edge 53 are present at a connection portion between the suction surface 54 and the pressure surface 55. All of the leading edge 52, the trailing edge 53, the suction surface 54, and the pressure surface 55 extend in a direction having a direction component of the radial direction Dr. The leading edge 52 is located on the axial upstream side Dau with respect to the trailing edge 53.

The shroud cover 60 includes a contact surface 73 on both sides in the circumferential direction Dc. The contact surface 73 in the shroud cover 60 faces and contacts a contact surface 73 of the shroud cover 60 of another rotor blade 50 adjacent to the rotor blade 50 having the shroud cover 60 in the circumferential direction Dc.

Figure 4:
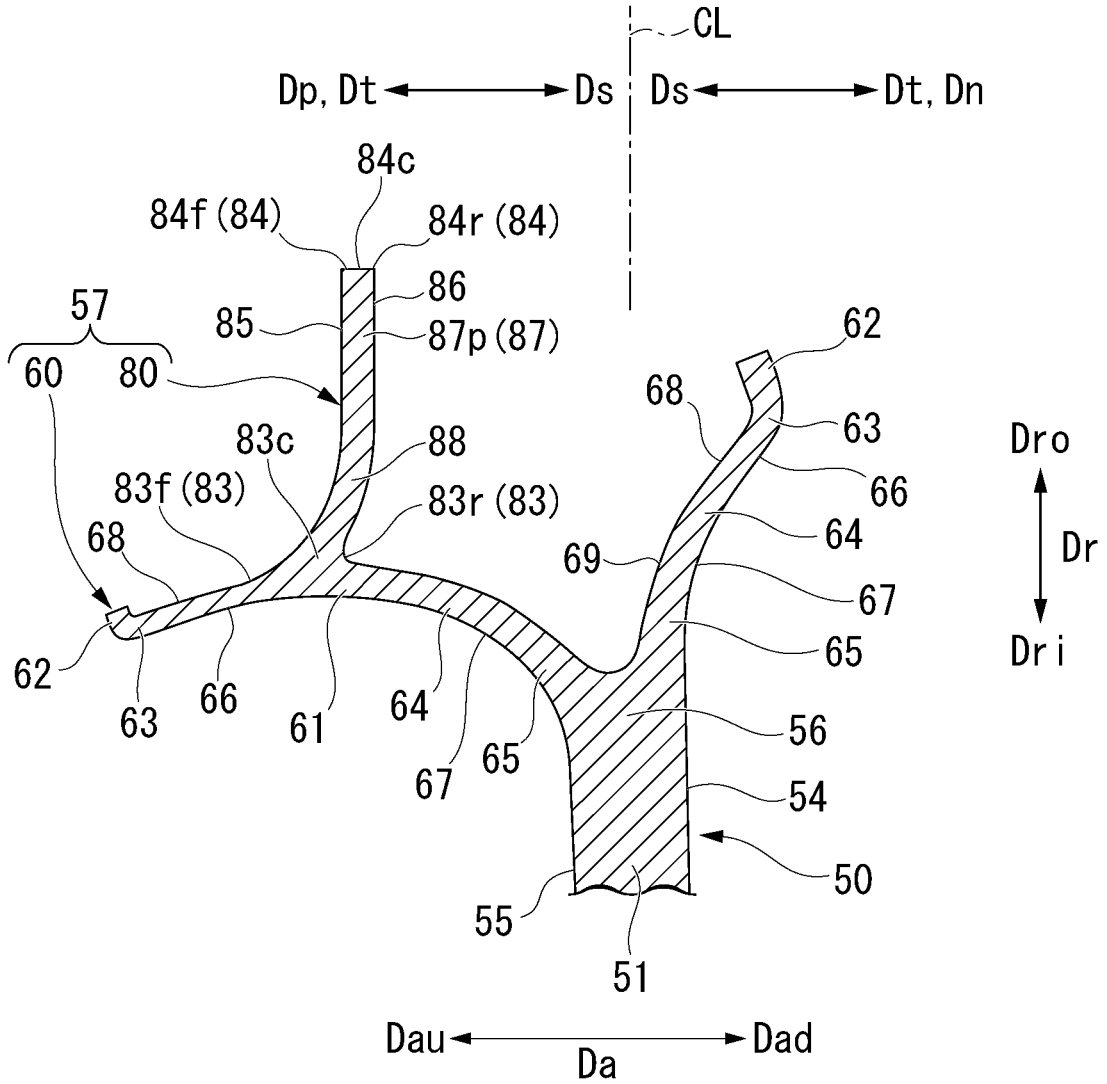
FIG. 4 is a cross-sectional view taken along a line IV-IV of FIG. 3 showing the rotor blade according to the first embodiment of the present invention.
Figure 5:
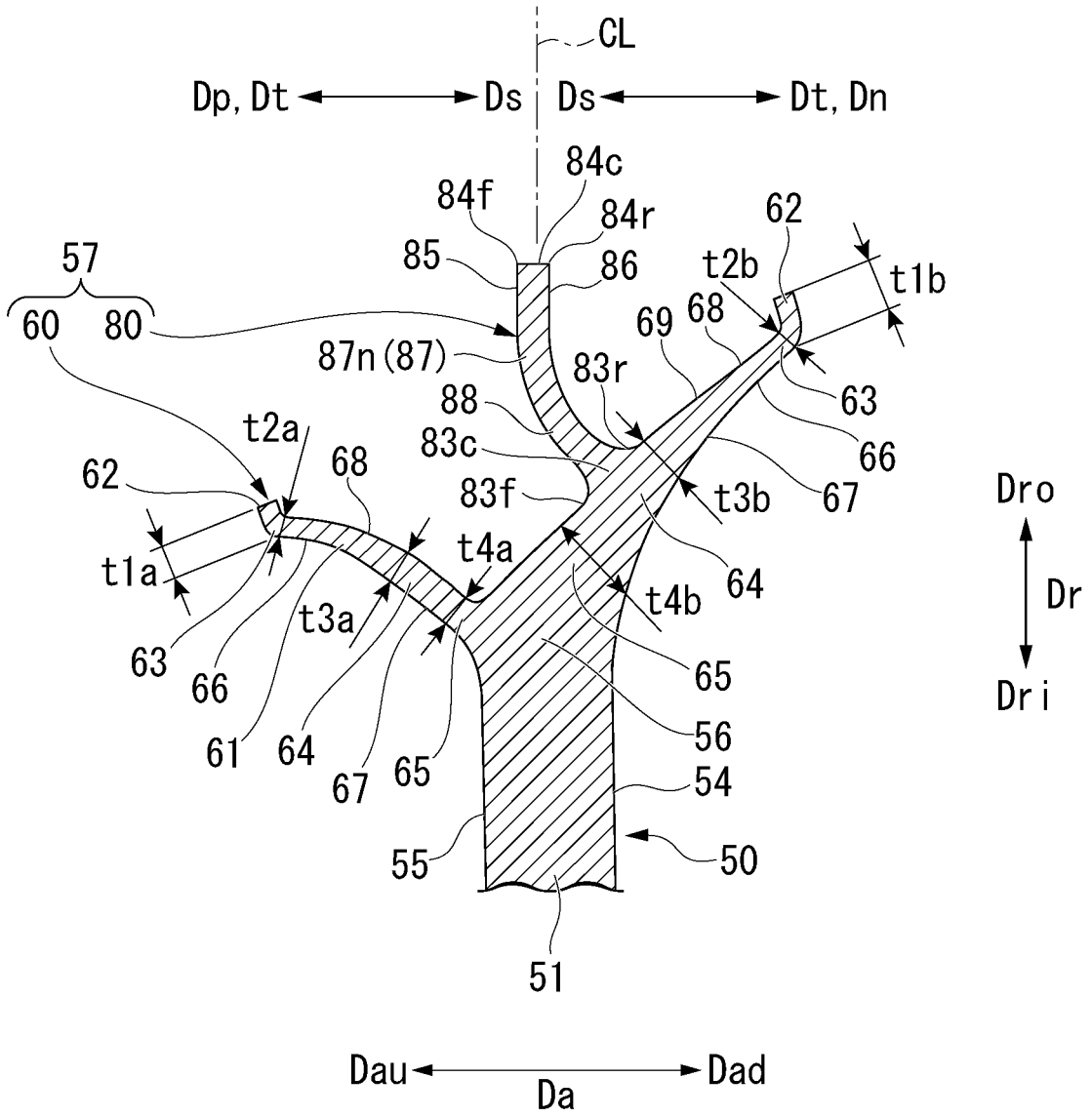
FIG. 5 is a cross-sectional view taken along a line V-V of FIG. 3 showing the rotor blade according to the first embodiment of the present invention.
Figure 6:
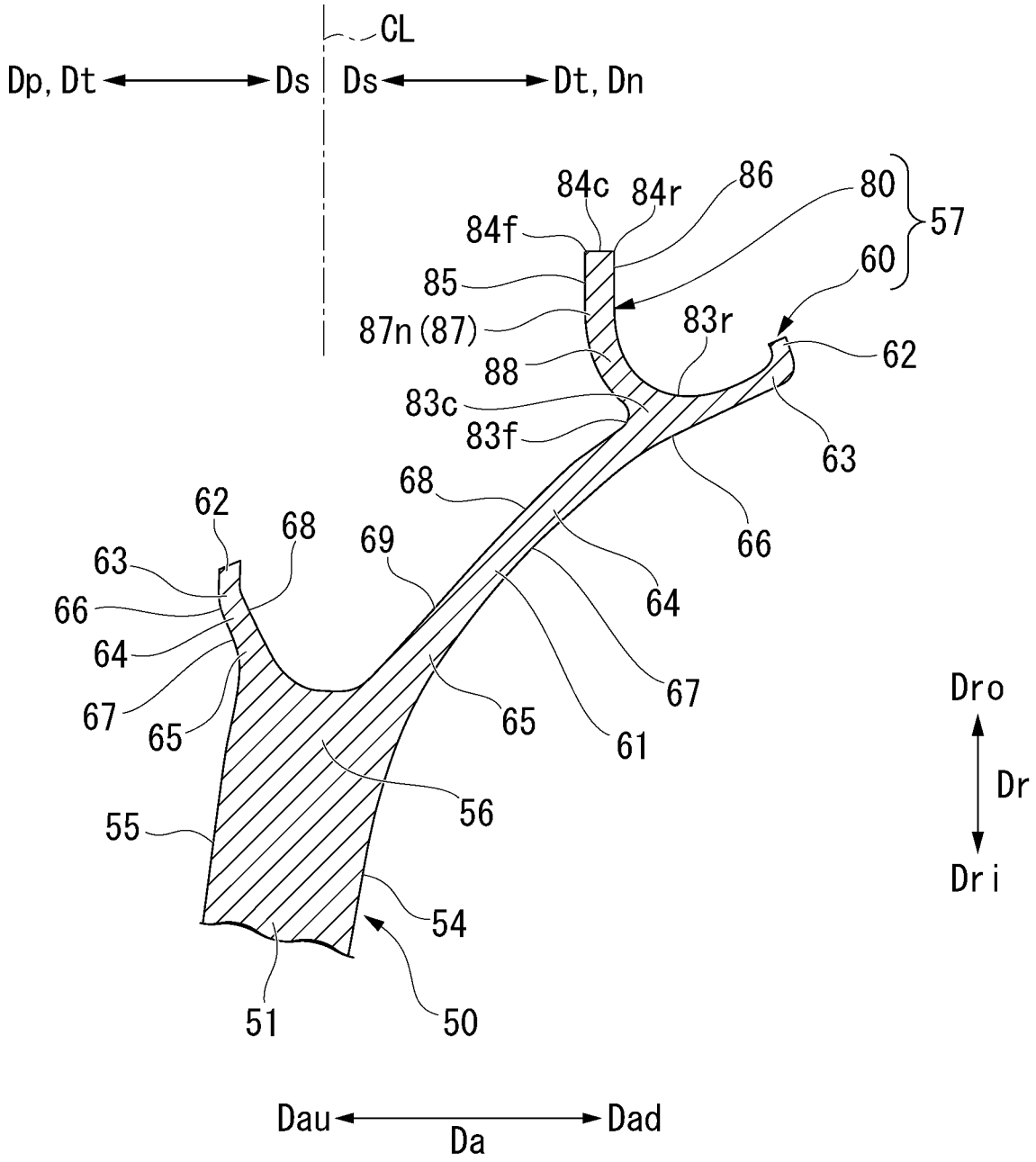
FIG. 6 is a cross-sectional view taken along a line VI-VI of FIG. 3 showing the rotor blade according to the first embodiment of the present invention.

In a cross-section orthogonal to a camber line CL of the blade body 51 as shown in FIGS. 4 to 6, the shroud cover 60 extends in both directions Dt of which each separates away from the blade body 51. Additionally, FIG. 4 is a cross-sectional view taken along a line IV-IV of FIG. 3, FIG. 5 is a cross-sectional view taken along a line V-V of FIG. 3, and FIG. 6 is a cross-sectional view taken along a line VI-VI of FIG. 3. All these cross-sectional views are cross-sectional views in a cross-section orthogonal to the camber line CL of the blade body 51. Further, in these cross-sectional views, a member existing at the inside of the cross-section is not depicted. Each of the directions Dt separates away from the blade body 51 and is orthogonal to the radial direction Dr. Also, each of directions Ds comes close to the blade body 51 and is orthogonal to the radial direction Dr. Thus, the direction Ds is opposite to the direction Dt. One direction Dt on the suction side Dn in which the suction surface 54 exists with respect to the camber line CL is opposite to the other direction Dt on the pressure side Dp in which the pressure surface 55 exists with respect to the camber line CL. Also, one direction Ds on the suction side Dn with respect to the camber line CL is opposite to the other direction Ds on the pressure side Dp with respect to the camber line CL.

The shroud cover 60 includes a cover main body 61 and an outer edge portion 62 which is connected to the cover main body 61. The outer edge portion 62 is located in the direction Dt in relation to the cover main body 61 in a cross-section orthogonal to the camber line CL. In other words, the cover main body 61 is located in the direction Ds in relation to the outer edge portion 62 in a cross-section orthogonal to the camber line CL. The outer edge portion 62 protrudes in the radial direction Dr with respect to the cover main body 61. In the embodiment, the outer edge portion 62 protrudes toward the radially outward side Dro with respect to the cover main body 61. The above-described contact surface 73 is formed in a part of the outer edge portion 62.

All of the cover main body 61 and the outer edge portion 62 include a gas path surface 66 and a back surface 68 which is opposite to the gas path surface 66. The gas path surface 66 is exposed to the outside of the rotor blade 50 toward the radially inward side Dri. The back surface 68 is exposed to the outside of the rotor blade 50 toward the radially outward side Dro.

The gas path surface 66 includes a fillet surface 67 which gradually extends to the radially outward side Dro as it separates from the blade body 51 in the direction Dt in a cross-section orthogonal to the camber line CL. The fillet surface 67 is curved. The back surface 68 includes a recessed surface 69 which extends so as to be recessed toward the radially inward side Dri as it comes close to the blade body 51 in the direction Ds in a cross-section orthogonal to the camber line CL. In other words, the recessed surface 69 extends so as to be recessed toward the radially inward side Dri along the fillet surface 67 in the gas path surface 66. The recessed surface 69 extends toward both sides with respect to the camber line CL. For this reason, in a cross-section orthogonal to the camber line CL, a part of the recessed surface 69 is located on the suction side Dn with respect to the camber line CL and the rest of the recessed surface 69 is located on the pressure side Dp with respect to the camber line CL. A part of the recessed surface 69 located on the suction side Dn is inclined toward the pressure side Dp as it goes toward the radially inward side Dri and the rest of the recessed portion located on the pressure side Dp is inclined toward the suction side Dn as it goes toward the radially inward side Dri. Thus, a part of the recessed surface 69 located on the suction side Dn and the rest of the recessed portion located on the pressure side Dp are inclined in the opposite directions.

The cover main body 61 includes a main body end portion 63, a main body intermediate portion 64, and a blade side portion 65. The main body intermediate portion 64 is a portion corresponding to an intermediate portion of the fillet surface 67 in the direction Ds of the cover main body 61 in a cross-section orthogonal to the camber line CL. The blade side portion 65 is a portion which is located in the direction Ds in relation to the main body intermediate portion 64 of the cover main body 61 in a cross-section orthogonal to the camber line CL. The main body end portion 63 is a portion which is a portion located in the direction Dt in relation to the main body intermediate portion 64 in the cover main body 61 and is connected to the outer edge portion 62. The recessed surface 69 is formed throughout the main body end portion 63, the main body intermediate portion 64, and the blade side portion 65.

Here, a distance between the gas path surface 66 and the back surface 68 is set to a cover thickness. In the cross-sections shown in FIGS. 4 to 6, the cover thicknesses t1*a* and t1*b* of the outer edge portion 62 are thicker than the cover thicknesses t2*a* and t2*b* of the main body end portion 63. The cover thicknesses t3*a* and t3*b* of the main body intermediate portion 64 are also thicker than the cover thicknesses t2*a* and t2*b* of the main body end portion 63. Further, the cover thicknesses t4*a* and t4*b* of the blade side portion 65 are also thicker than the cover thicknesses t2*a* and t2*b* of the main body end portion 63. That is, the cover thicknesses t2*a* and t2*b* of the main body end portion 63 are the thinnest in any cross-section.

The seal fin 80 protrudes from, as shown in FIGS. 3 to 6, the back surface 68 of the shroud cover 60 toward the radially outward side Dro. The seal fin 80 extends in a direction having a component in the circumferential direction Dc from a first outer edge 71 which is a part of the outer edge of the back surface 68 to a second outer edge 72 which is another part of the outer edge of the back surface 68 over the camber line CL of the blade body 51. Additionally, the first outer edge 71 is an outer edge on a forward rotation side Dcf (see FIG. 3) in the circumferential direction Dc of the outer edge of the back surface 68. Further, the second outer edge 72 is an outer edge on a backward rotation side Dcr in the circumferential direction Dc of the outer edge of the back surface 68. The forward rotation side Dcf is a rotation side of the rotor shaft 42 (see FIG. 1) in both sides of the circumferential direction Dc. Further, the backward rotation side Dcr is a side opposite to the forward rotation side Dcf in both sides of the circumferential direction Dc.

The seal fin 80 includes a base end 83 which intersects the back surface 68, a front end 84 which is on the most radial outside Dro, a front surface 85 which faces the axial upstream side Dau, and a rear surface 86 which faces the axial downstream side Dad. The base end 83 includes a forward base end 83*f* which is an end on the most radial inside Dri in the front surface 85 and a backward base end 83*r* which is an end on the most radial inside Dri in the rear surface 86. The forward base end 83*f* is an intersection position between the back surface 68 and the front surface 85. Further, the backward base end 83*r* is an intersection position between the back surface 68 and the rear surface 86. The front end 84 includes a forward front end 84*f* which is an end on the most radial outside Dro in the front surface 85 and a backward front end 84*r* which is an end on the most radial outside Dro in the rear surface 86.

Further, the seal fin 80 includes a first end portion 81 (see FIG. 3) which protrudes from the first outer edge 71 of the back surface 68 toward the radially outward side Dro, a second end portion 82 which protrudes from the second outer edge 72 of the back surface 68 toward the radially outward side Dro, and a shift portion 87 in which a center position 83*c* of the base end 83 in the axial direction Da is shifted toward the axial direction Da with respect to the center position of the front end 84 in the axial direction. The shift portion 87 exists between the first end portion 81 and the second end portion 82. The shift portion 87 includes an inclined portion 88 which is inclined in the axial direction Da toward the radially inward side Dri. In the embodiment, the inclined portion 88 is formed in a region not including the front end 84 but including the base end 83. Further, the shift portion 87 includes a pressure side shift portion 87*p* and a suction side shift portion 87*n* (see FIG. 3). The pressure side shift portion 87*p* is located on the pressure side Dp with respect to the camber line CL. The suction side shift portion 87*n* is located on the suction side Dn with respect to the camber line CL.

In the embodiment, as shown in FIGS. 3 and 4, the forward base end 83*f* of the pressure side shift portion 87*p* is shifted toward the axial upstream side Dau with respect to the forward front end 84*f* of the pressure side shift portion 87*p*. Further, in the embodiment, the backward base end 83*r* of the pressure side shift portion 87*p* is shifted toward the axial upstream side Dau with respect to the backward front end 84*r* of the pressure side shift portion 87*p*. For this reason, in the pressure side shift portion 87*p* of the embodiment, the center position 83*c* of the base end 83 in the axial direction Da is shifted toward the axial upstream side Dau with respect to the center position 84*c* of the front end 84 in the axial direction Da.

In the embodiment, as shown in FIGS. 3, 5, and 6, the forward base end 83*f* of the suction side shift portion 87*n* is shifted toward the axial downstream side Dad with respect to the forward front end 84*f* of the suction side shift portion 87*n*. Further, in the embodiment, the backward base end 83*r* of the suction side shift portion 87*n* is shifted toward the axial downstream side Dad with respect to the backward front end 84*r* of the suction side shift portion 87*n*. For this reason, in the suction side shift portion 87*n* of the embodiment, the center position 83*c* of the base end 83 in the axial direction Da is shifted toward the axial downstream side Dad with respect to the center position 84*c* of the front end 84 in the axial direction Da.

As shown in FIG. 3, the first end portion 81 of the seal fin 80 needs to face in the circumferential direction Dc from the base end 83 to the front end 84 of the second end portion 82 of the seal fin 80 of another rotor blade 50 adjacent to the rotor blade 50 having the seal fin 80 on the forward rotation side Dcf. Further, the second end portion 82 of the seal fin 80 needs to face in the circumferential direction Dc from the base end 83 to the front end 84 of the first end portion 81 of the seal fin 80 of another rotor blade 50 adjacent to the rotor blade 50 having the seal fin 80 on the backward rotation side Dcr. For this reason, in the first end portion 81 and the second end portion 82 of the seal fin 80, the center position 83*c* of the base end 83 in the axial direction Da matches the center position 84*c* of the front end 84 in the axial direction Da.

A distance from the front end 84 of the seal fin 80 to the axis Ar is uniform regardless of the position in the circumferential direction Dc. However, the fin height at the position of the intermediate portion between the first end portion 81 and the second end portion 82 is higher than the fin height of the first end portion 81 of the seal fin 80 (see FIG. 3) and the fin height of the second end portion 82 of the seal fin 80. This is because the back surface 68 includes the recessed surface 69. Additionally, the fin height indicates a distance from the back surface 68 to the front end 84 of the seal fin 80.

As described above, in the embodiment, since the back surface 68 includes the recessed surface 69 which is recessed toward the radially inward side Dri, it is possible to reduce the weight of the shroud cover 60.

Stress is generated in the base portion of the shroud cover 60 with respect to the blade body 51. As a method of reducing this stress, a method of increasing the curvature radius of the fillet surface 67 is known. The recessed surface 69 of the embodiment extends so as to be recessed to the radially inward side Dri along the fillet surface 67 in the gas path surface 66. For this reason, in the embodiment, even when the curvature radius of the fillet surface 67 is large, a cover thickness which is a distance between the gas path surface 66 and the back surface 68 is not thick. Thus, in the embodiment, it is possible to reduce the weight of the shroud cover 60 while reducing the stress generated in the base portion of the shroud cover 60 with respect to the blade body 51. Further, in the embodiment, since the recessed surface 69 extends toward both sides with respect to the camber line CL, it is possible to further reduce the weight of the shroud cover 60.

In the embodiment, since the outer edge portion 62 which protrudes in the radial direction Dr with respect to the cover main body 61 is provided, it is possible to increase the rigidity of the outer edge of the shroud cover 60 while suppressing an increase in weight of the shroud cover 60.

In the embodiment, the cover thicknesses t2*a* and t2*b* of the main body end portion 63 located at a region farther from the camber line CL in relation to the main body intermediate portion 64 are the thinnest in the shroud cover 60. For this reason, in the embodiment, it is possible to suppress an increase in moment applied to the shroud cover 60 based on the camber line CL while increasing the rigidity of the outer edge of the shroud cover 60 by the outer edge portion 62.

Additionally, in the embodiment, the size relationship of the cover thicknesses t1*a* and t1*b* of the outer edge portion 62, the cover thicknesses t3*a* and t3*b* of the main body intermediate portion 64, and the cover thicknesses t4*a* and t4*b* of the blade side portion 65 does not matter.

Further, as shown in FIG. 3, the contact surface 73 on the forward rotation side Dcf of the shroud cover 60 contacts the contact surface 73 on the backward rotation side Dcr of the shroud cover 60 of another rotor blade 50 adjacent to the rotor blade 50 having the seal fin 80 on the forward rotation side Dcf. A load directed toward the radially outward side Dro is applied to the edge of the shroud cover 60 on the forward rotation side Dcf due to a centrifugal force. A distance between the camber line CL and a portion on the axial upstream side Dau in relation to the seal fin 80 in the edge on the forward rotation side Dcf is larger than a distance between the camber line CL and a portion on the axial downstream side Dad in relation to the seal fin 80 in the edge on the forward rotation side Dcf. For this reason, the moment based on the camber line CL applied to a portion 75*u* on the axial upstream side Dau in relation to the seal fin 80 in the edge on the forward rotation side Dcf is larger than the moment based on the camber line CL according to a portion on the axial downstream side Dad in relation to the seal fin 80 in the edge of the forward rotation side Dcf. For this reason, large moment directed toward the radially outward side Dro is applied to the portion 75*u* on the axial upstream side Dau in relation to the seal fin 80 in the edge on the forward rotation side Dcf.

Further, the contact surface 73 on the backward rotation side Dcr of the shroud cover 60 contacts the contact surface 73 on the forward rotation side Dcf of the shroud cover 60 of another rotor blade 50 adjacent to the rotor blade 50 having the seal fin 80 on the backward rotation side Dcr. A load directed toward the radially outward side Dro is applied to the edge of the shroud cover 60 on the backward rotation side Dcr due to a centrifugal force. A distance between the camber line CL and a portion on the axial downstream side Dad in relation to the seal fin 80 in the edge on the backward rotation side Dcr is larger than a distance between the camber line CL and a portion on the axial upstream side Dau in relation to the seal fin 80 in the edge on the backward rotation side Dcr. For this reason, the moment based on the camber line CL applied to a portion 75*d* on the axial downstream side Dad in relation to the seal fin 80 in the edge on the backward rotation side Dcr is larger than the moment based on the camber line CL according to a portion on the axial upstream side Dau in relation to the seal fin 80 in the edge on the backward rotation side Dcr. For this reason, large moment directed toward the radially outward side Dro is applied to the portion 75*d* on the axial downstream side Dad in relation to the seal fin 80 in the edge on the backward rotation side Dcr.

As described above, when large moment directed toward the radially outward side Dro is applied to the portions 75*u* and 75*d* of the shroud cover 60, the portions 75*u* and 75*d* will be deformed toward the radially outward side Dro with respect to the other portions. As a method of suppressing this deformation, a method of thickening the thickness of the shroud cover 60 or a method of thickening the thickness from the base end 83 to the front end 84 of the seal fin 80 is considered.

In the embodiment, the base end 83 of the shift portion 87 of the seal fin 80 exists in the vicinity of the portions 75*u* and 75*d* to which large moment directed toward the radially outward side Dro is applied in the shroud cover 60. Thus, in the embodiment, it is possible to suppress the deformation of the portions 75*u* and 75*d* that receive large moment directed toward the radially outward side Dro in the shroud cover 60 with respect to the other portions. Further, in the embodiment, the base end 83 is located in the vicinity of the portions 75*u* and 75*d* that receive large moment directed toward the radially outward side Dro by shifting the base end 83 of the seal fin 80 in the axial direction Da in relation to the front end 84 without adopting a method of thickening the thickness of the shroud cover 60 or a method of thickening the thickness from the base end 83 to the front end 84 of the seal fin 80. Thus, in the embodiment, since the seal fin 80 includes the shift portion 87, it is possible to suppress the deformation of the shroud cover 60 while suppressing an increase in weight of the shroud 57.

As described above, in the embodiment, since the back surface 68 of the shroud cover 60 includes the recessed surface 69 and the seal fin 80 includes the shift portion 87, it is possible to improve the durability of the shroud cover 60 while suppressing an increase in weight of the shroud 57.

"Second embodiment of rotor blade"

Figure 7:
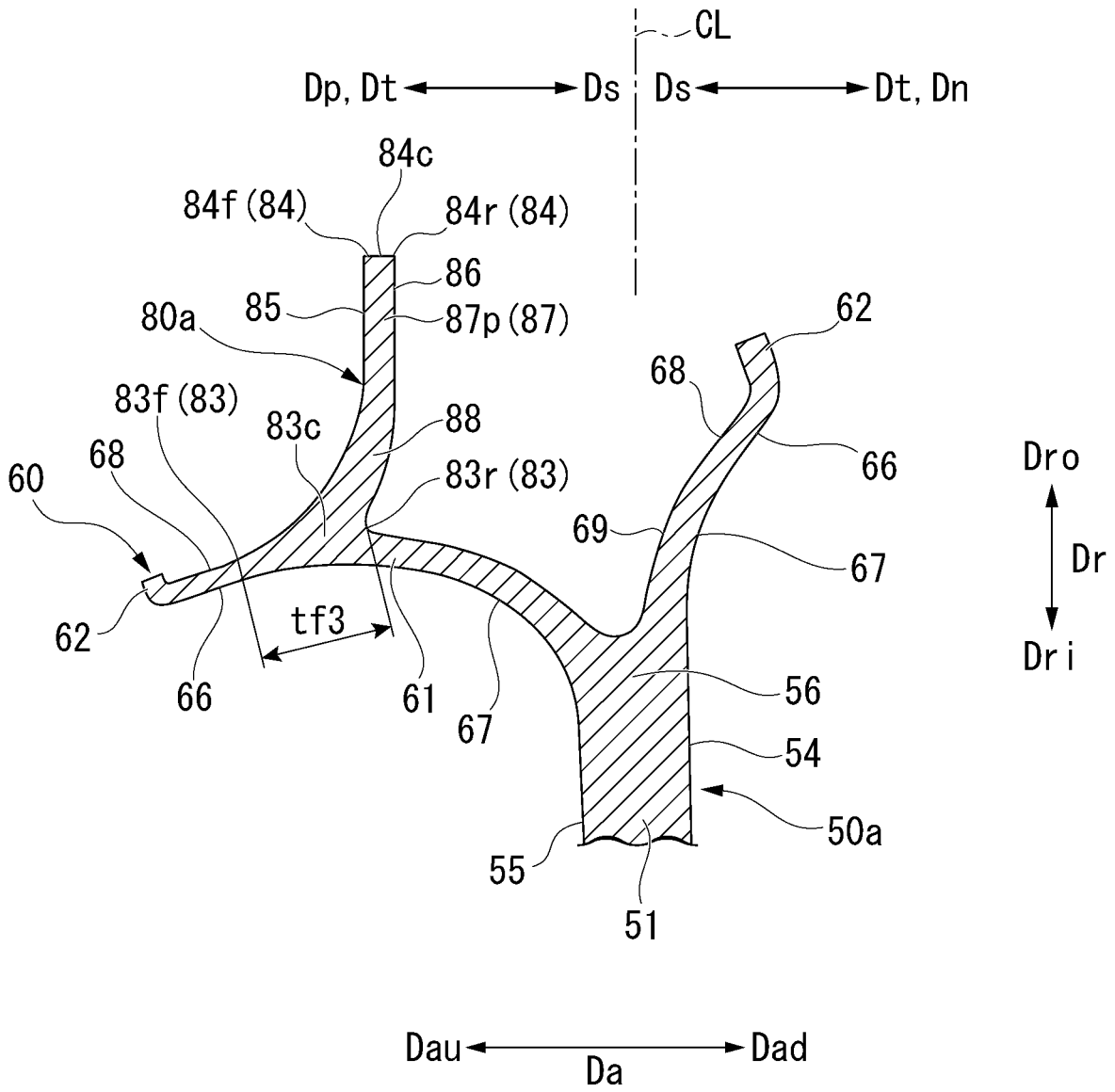
FIG. 7 is a cross-sectional view taken along a line VII-VII of FIG. 3 for a rotor blade according to a second embodiment of the present invention.
Figure 8:
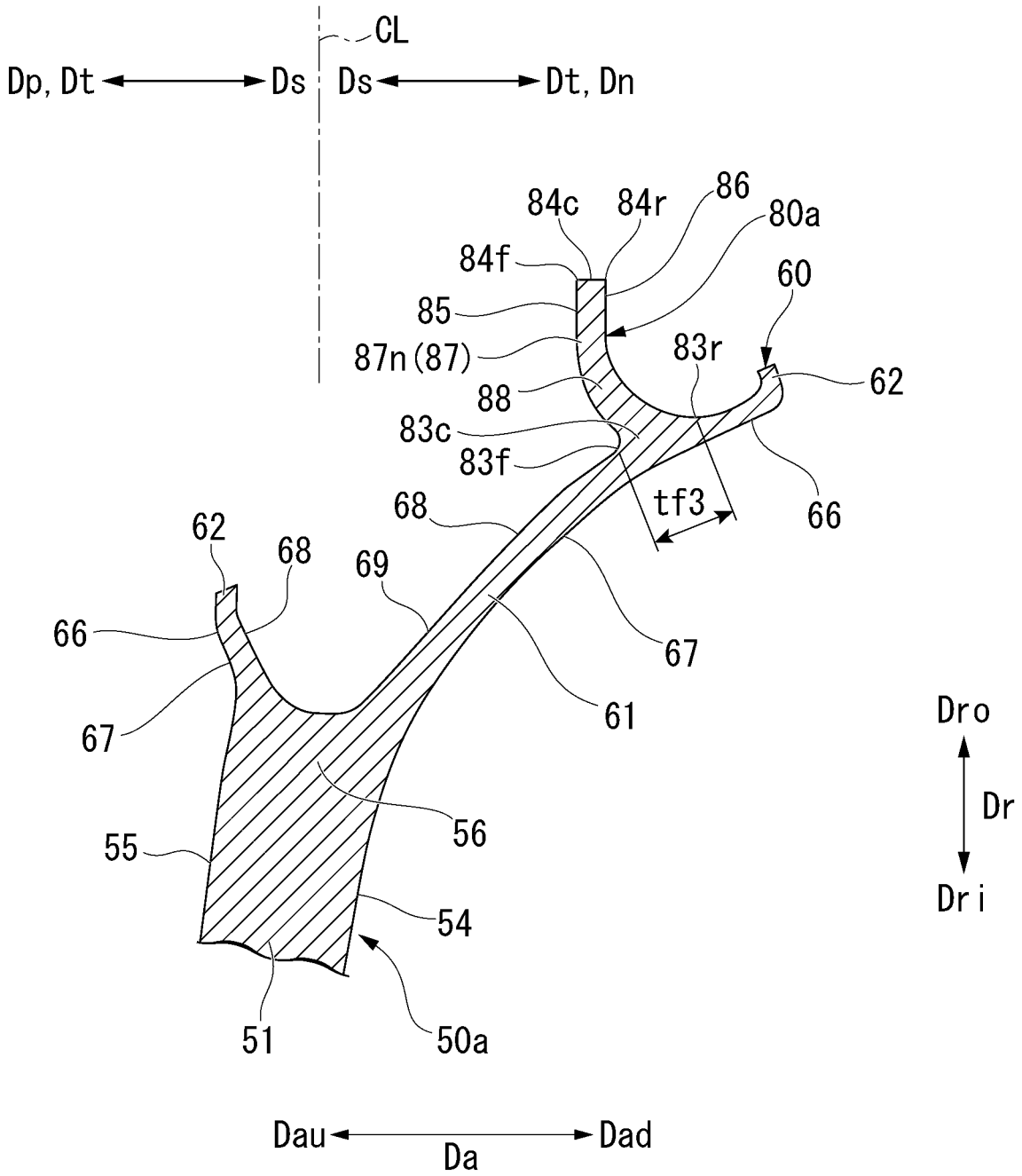
FIG. 8 is a cross-sectional view taken along a line VIII-VIII of FIG. 3 for the rotor blade according to the second embodiment of the present invention.

Referring to FIGS. 3, 7, and 8, a rotor blade according to a second embodiment of the present invention will be described.

As shown in FIGS. 7 and 8, a rotor blade 50*a* of the embodiment is a rotor blade obtained by changing the shape of the seal fin 80 of the rotor blade 50 of the first embodiment and the other configurations are the same as those of the rotor blade 50 of the first embodiment. Additionally, FIG. 7 is a cross-sectional view taken along a line VII-VII of FIG. 3 and FIG. 8 is a cross-sectional view taken along a line VIII-VIII of FIG. 3. Further, in the description of the rotor blade 50*a* of the embodiment, the seal fin 80 of the first embodiment is depicted in FIG. 3 for convenience of description since FIG. 3 showing the rotor blade 50 of the first embodiment is used. However, the shape of a seal fin 80*a* when the rotor blade 50*a* of the embodiment is viewed from the radially outward side Dro is different from the shape of the seal fin 80 shown in FIG. 3.

The seal fin 80*a* of the embodiment also protrudes from the back surface 68 of the shroud cover 60 toward the radially outward side Dro as shown in FIGS. 7 and 8 similarly to the seal fin 80 of the first embodiment. The seal fin 80*a* also extends in a direction having a component in the circumferential direction Dc from the first outer edge 71 (see FIG. 3) which is a part of the outer edge of the back surface 68 to the second outer edge 72 which is another part of the outer edge of the back surface 68 over the camber line CL of the blade body 51 similarly to the seal fin 80 of the first embodiment.

The seal fin 80*a* also includes the base end 83, the front end 84, the front surface 85, and the rear surface 86 similarly to the seal fin 80 of the first embodiment. Further, the base end 83 includes the forward base end 83*f* and the backward base end 83*r*. The front end 84 includes the forward front end 84*f* and the backward front end 84*r*.

Further, the seal fin 80*a* also includes, as shown in FIG. 3, the first end portion 81 which protrudes from the first outer edge 71 of the back surface 68 toward the radially outward side Dro, the second end portion 82 which protrudes from the second outer edge 72 of the back surface 68 toward the radially outward side Dro, and the shift portion 87 in which the center position 83*c* of the base end 83 in the axial direction Da is shifted toward the axial direction Da with respect to the center position 84*c* of the front end 84 in the axial direction Da similarly to the seal fin 80 of the first embodiment. The shift portion 87 exists between the first end portion 81 and the second end portion 82. The shift portion 87 includes the inclined portion 88 which faces the axial direction Da as it goes toward the radially inward side Dri. The shift portion 87 includes the pressure side shift portion 87*p* and the suction side shift portion 87*n*.

In the embodiment, as shown in FIG. 7, the forward base end 83*f* of the pressure side shift portion 87*p* is shifted toward the axial upstream side Dau with respect to the forward front end 84*f* of the pressure side shift portion 87*p*. Further, in the embodiment, the backward base end 83*r* of the pressure side shift portion 87*p* is shifted toward the axial upstream side Dau with respect to the backward front end 84*r* of the pressure side shift portion 87*p*. For this reason, also in the pressure side shift portion 87*p* of the embodiment, the center position 83*c* of the base end 83 in the axial direction Da is shifted toward the axial upstream side Dau with respect to the center position 84*c* of the front end 84 in the axial direction Da similarly to the pressure side shift portion 87*p* of the first embodiment.

In the embodiment, as shown in FIG. 8, the forward base end 83*f* of the suction side shift portion 87*n* is shifted toward the axial downstream side Dad with respect to the forward front end 84*f* of the suction side shift portion 87*n*. Further, in the embodiment, the backward base end 83*r* of the suction side shift portion 87*n* is shifted toward the axial downstream side Dad with respect to the backward front end 84*r* of the suction side shift portion 87*n*. For this reason, also in the suction side shift portion 87*n* of the embodiment, the center position 83*c* of the base end 83 in the axial direction Da is shifted toward the axial downstream side Dad with respect to the center position 84*c* of the front end 84 in the axial direction Da similarly to the suction side shift portion 87*n* of the first embodiment.

The configuration of the seal fin 80*a* of the embodiment described above is the same as the configuration of the seal fin 80 of the first embodiment.

However, in the embodiment, the shift amount of the forward base end 83*f* of the pressure side shift portion 87*p* toward the axial upstream side Dau with respect to the forward front end 84*f* of the pressure side shift portion 87*p* is larger than the shift amount of the backward base end 83*r* of the pressure side shift portion 87*p* toward the axial upstream side Dau with respect to the backward front end 84*r* of the pressure side shift portion 87*p*. For this reason, the thickness tf3 (see FIG. 7) of the base end 83 of the pressure side shift portion 87*p* of the embodiment in the axial direction Da is thicker than the thickness of the base end 83 of the pressure side shift portion 87*p* of the first embodiment in the axial direction Da. Further, in the embodiment, the shift amount of the backward base end 83*r* of the suction side shift portion 87*n* toward the axial downstream side Dad with respect to the backward front end 84*r* of the suction side shift portion 87*n* is larger than the shift amount of the forward base end 83*f* of the suction side shift portion 87*n* toward the axial downstream side Dad with respect to the forward front end 84*f* of the suction side shift portion 87*n*. For this reason, the thickness tf3 (see FIG. 8) of the base end 83 of the suction side shift portion 87*n* of the embodiment in the axial direction Da is thicker than the thickness of the base end 83 of the suction side shift portion 87*n* of the first embodiment in the axial direction Da.

As described above, the rotor blade 50*a* of the embodiment is a rotor blade obtained by changing the shape of the seal fin 80 of the rotor blade 50 of the first embodiment and the other configurations are the same as those of the rotor blade 50 of the first embodiment. Thus, the back surface 68 of the embodiment also includes the recessed surface 69 which is recessed toward the radially inward side Dri similarly to the back surface 68 of the first embodiment. Thus, also in the embodiment, it is possible to reduce the weight of the shroud cover 60 while reducing the stress generated in the base portion of the shroud cover 60 with respect to the blade body 51 similarly to the first embodiment.

Further, since the seal fin 80*a* of the embodiment includes the shift portion 87 in which the center position 83*c* of the base end 83 in the axial direction Da is shifted toward the axial direction Da with respect to the center position 84*c* of the front end 84 in the axial direction Da similarly to the seal fin 80 of the first embodiment, it is possible to suppress the deformation of the shroud cover 60 while suppressing an increase in weight of the shroud.

Further, since the thickness of the base end 83 of the shift portion 87 of the embodiment in the axial direction Da is thicker than the thickness of the base end 83 of the shift portion 87 of the first embodiment in the axial direction Da, it is possible to reduce the stress generated in the base end 83 and to further suppress the deformation of the shroud cover 60 as compared to the first embodiment.

"Third embodiment of rotor blade"

Figure 9:
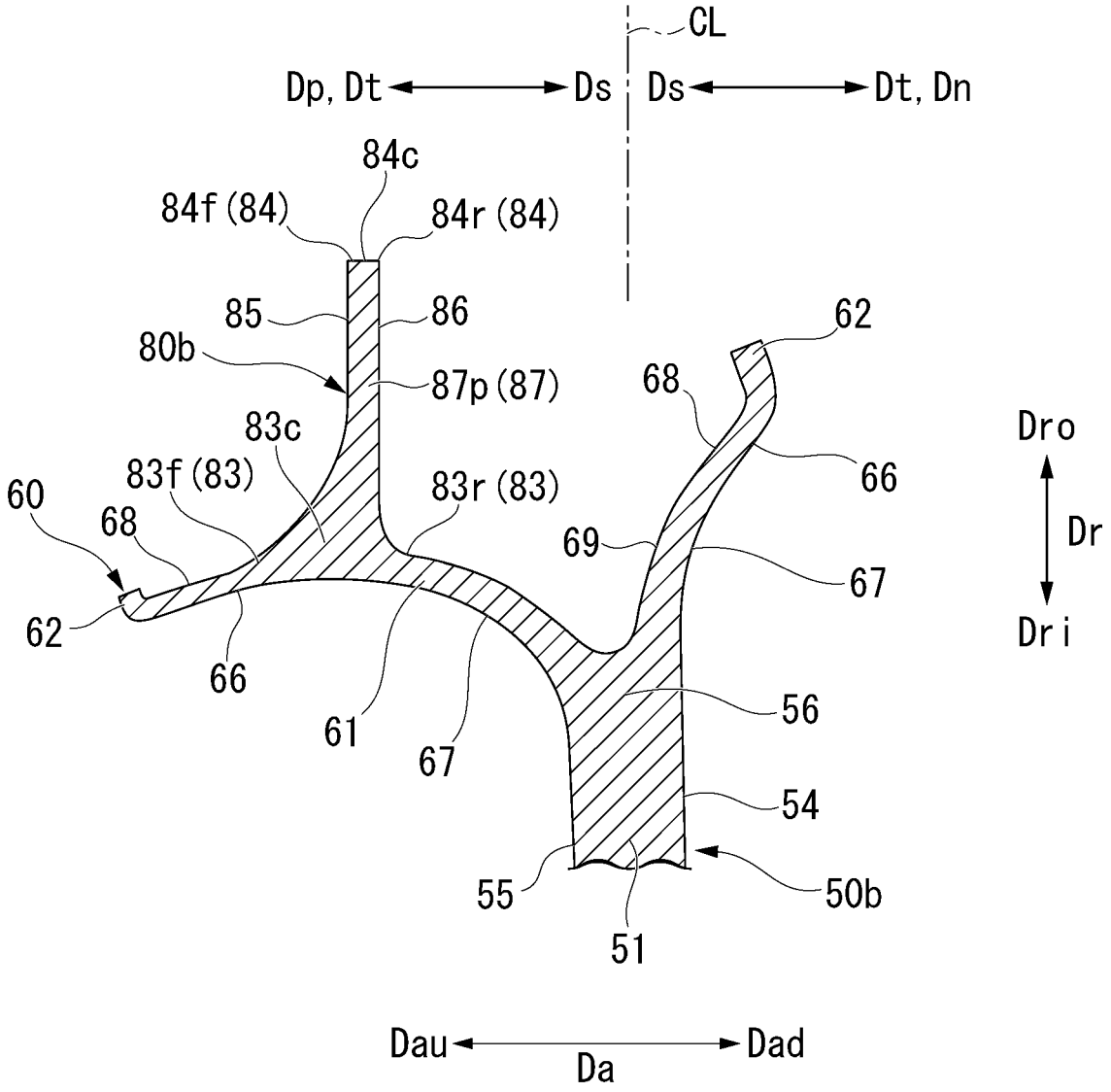
FIG. 9 is a cross-sectional view taken along a line IX-IX of FIG. 3 for a rotor blade according to a third embodiment of the present invention.
Figure 10:
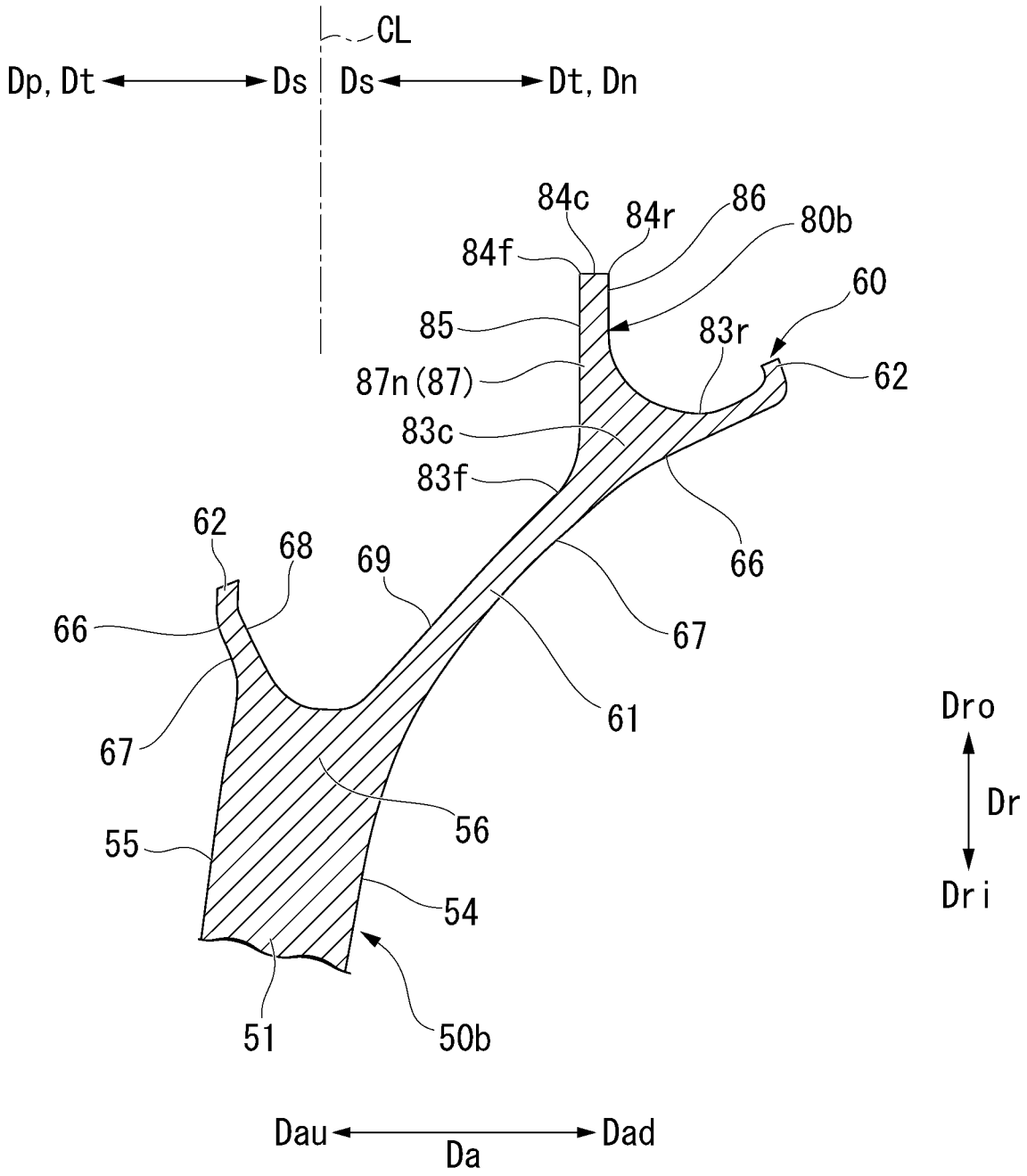
FIG. 10 is a cross-sectional view taken along a line X-X of FIG. 3 for the rotor blade according to the third embodiment of the present invention.

Referring to FIGS. 3, 9, and 10, a rotor blade according to a third embodiment of the present invention will be described.

As shown in FIGS. 9 and 10, the rotor blade 50*b* of the embodiment is a rotor blade obtained by changing the shape of the seal fin 80 of the rotor blade 50 of the first embodiment and the other configurations are the same as those of the rotor blade 50 of the first embodiment. Additionally, FIG. 9 is a cross-sectional view taken along a line IX-IX of FIG. 3 and FIG. 10 is a cross-sectional view taken along a line X-X of FIG. 3. Further, in the description of the rotor blade 50*b* of the embodiment, the seal fin 80 of the first embodiment is depicted in FIG. 3 for convenience of description since FIG. 3 showing the rotor blade 50 of the first embodiment is used. However, the shape of the seal fin 80*b* when the rotor blade 50*b* of the embodiment is viewed from the radially outward side Dro is different from the shape of the seal fin 80 shown in FIG. 3.

The seal fin 80*b* of the embodiment also protrudes from the back surface 68 of the shroud cover 60 toward the radially outward side Dro as shown in FIGS. 9 and 10 similarly to the seal fin 80 of the first embodiment. The seal fin 80*b* also extends in a direction having a component in the circumferential direction Dc from the first outer edge 71 (see FIG. 3) which is a part of the outer edge of the back surface 68 to the second outer edge 72 which is another part of the outer edge of the back surface 68 over the camber line CL of the blade body 51 similarly to the seal fin 80 of the first embodiment.

The seal fin 80*b* also includes the base end 83, the front end 84, the front surface 85, and the rear surface 86 similarly to the seal fin 80 of the first embodiment. Further, the base end 83 includes the forward base end 83*f* and the backward base end 83*r*. The front end 84 includes the forward front end 84*f* and the backward front end 84*r*.

Further, the seal fin 80*b* also includes, as shown in FIG. 3, the first end portion 81 which protrudes from the first outer edge 71 of the back surface 68 toward the radially outward side Dro, the second end portion 82 which protrudes from the second outer edge 72 of the back surface 68 toward the radially outward side Dro, and the shift portion 87 in which the center position 83*c* of the base end 83 in the axial direction Da is shifted toward the axial direction Da with respect to the center position 84*c* of the front end 84 in the axial direction Da similarly to the seal fin 80 of the first embodiment. The shift portion 87 exists between the first end portion 81 and the second end portion 82. The shift portion 87 includes the pressure side shift portion 87*p* and the suction side shift portion 87*n*.

In the embodiment, as shown in FIG. 9, the forward base end 83*f* of the pressure side shift portion 87*p* is shifted toward the axial upstream side Dau with respect to the forward front end 84*f* of the pressure side shift portion 87*p*. Further, in the embodiment, as shown in FIG. 10, the forward base end 83*f* of the suction side shift portion 87*n* is shifted toward the axial downstream side Dad with respect to the forward front end 84*f* of the suction side shift portion 87*n*.

The configuration of the seal fin 80*b* of the above-described embodiment is the same as the configuration of the seal fin 80 of the first embodiment.

However, in the embodiment, as shown in FIG. 9, the backward base end 83*r* of the pressure side shift portion 87*p* is shifted toward the axial downstream side Dad instead of the axial upstream side Dau with respect to the backward front end 84*r* of the pressure side shift portion 87*p*. In the embodiment, the shift amount of the backward base end 83*r* of the pressure side shift portion 87*p* toward the axial downstream side Dad with respect to the backward front end 84*r* of the pressure side shift portion 87*p* is smaller than the shift amount of the forward base end 83*f* of the pressure side shift portion 87*p* toward the axial upstream side Dau with respect to the forward front end 84*f* of the pressure side shift portion 87*p*. For this reason, also in the pressure side shift portion 87*p* of the embodiment, the center position 83*c* of the base end 83 in the axial direction Da is shifted toward the axial upstream side Dau with respect to the center position 84*c* of the front end 84 in the axial direction Da similarly to the pressure side shift portion 87*p* of the above-described embodiments.

Further, in the embodiment, as shown in FIG. 10, the forward base end 83*f* of the suction side shift portion 87*n* is shifted toward the axial upstream side Dau instead of the axial downstream side Dad with respect to the forward front end 84*f* of the suction side shift portion 87*n*. In the embodiment, the shift amount of the forward base end 83*f* of the suction side shift portion 87*n* toward the axial upstream side Dau with respect to the forward front end 84*f* of the suction side shift portion 87*n* is smaller than the shift amount of the backward base end 83*r* of the suction side shift portion 87*n* toward the axial downstream side Dad with respect to the backward front end 84*r* of the suction side shift portion 87*n*. For this reason, also in the suction side shift portion 87*n* of the embodiment, the center positions 83*c* and 84*c* of the base end 83 in the axial direction Da are shifted toward the axial downstream side with respect to the center positions 83*c* and 84*c* of the front end 84 in the axial direction Da similarly to the suction side shift portion 87*n* of the above-described embodiments.

As described above, the rotor blade 50*b* of the embodiment is a rotor blade obtained by changing the shape of the seal fin 80 of the rotor blade 50 of the first embodiment and the other configurations are the same as those of the rotor blade 50 of the first embodiment. Thus, the back surface 68 of the embodiment also includes the recessed surface 69 which is recessed toward the radially inward side Dri similarly to the back surface 68 of the first embodiment. Thus, also in the embodiment, it is possible to reduce the weight of the shroud cover 60 while reducing the stress generated in the base portion of the shroud cover 60 with respect to the blade body 51 similarly to the first embodiment.

Further, since the seal fin 80*b* of the embodiment includes the shift portion 87 in which the center position 83*c* of the base end 83 in the axial direction Da is shifted toward the axial direction Da with respect to the center position 84*c* of the front end 84 in the axial direction Da similarly to the seal fin 80 of the first embodiment, it is possible to suppress the deformation of the shroud cover 60 while suppressing an increase in weight of the shroud.

Further, the thickness of the base end 83 of the shift portion 87 of the embodiment in the axial direction Da is thicker than the thickness of the base end 83 of the shift portion 87 in the axial direction Da of the first embodiment and the second embodiment. For this reason, in the embodiment, it is possible to reduce the stress generated in the base end 83 and to further suppress the deformation of the shroud cover 60 as compared to the first embodiment and the second embodiment.

"Fourth embodiment of rotor blade"

Figure 11:
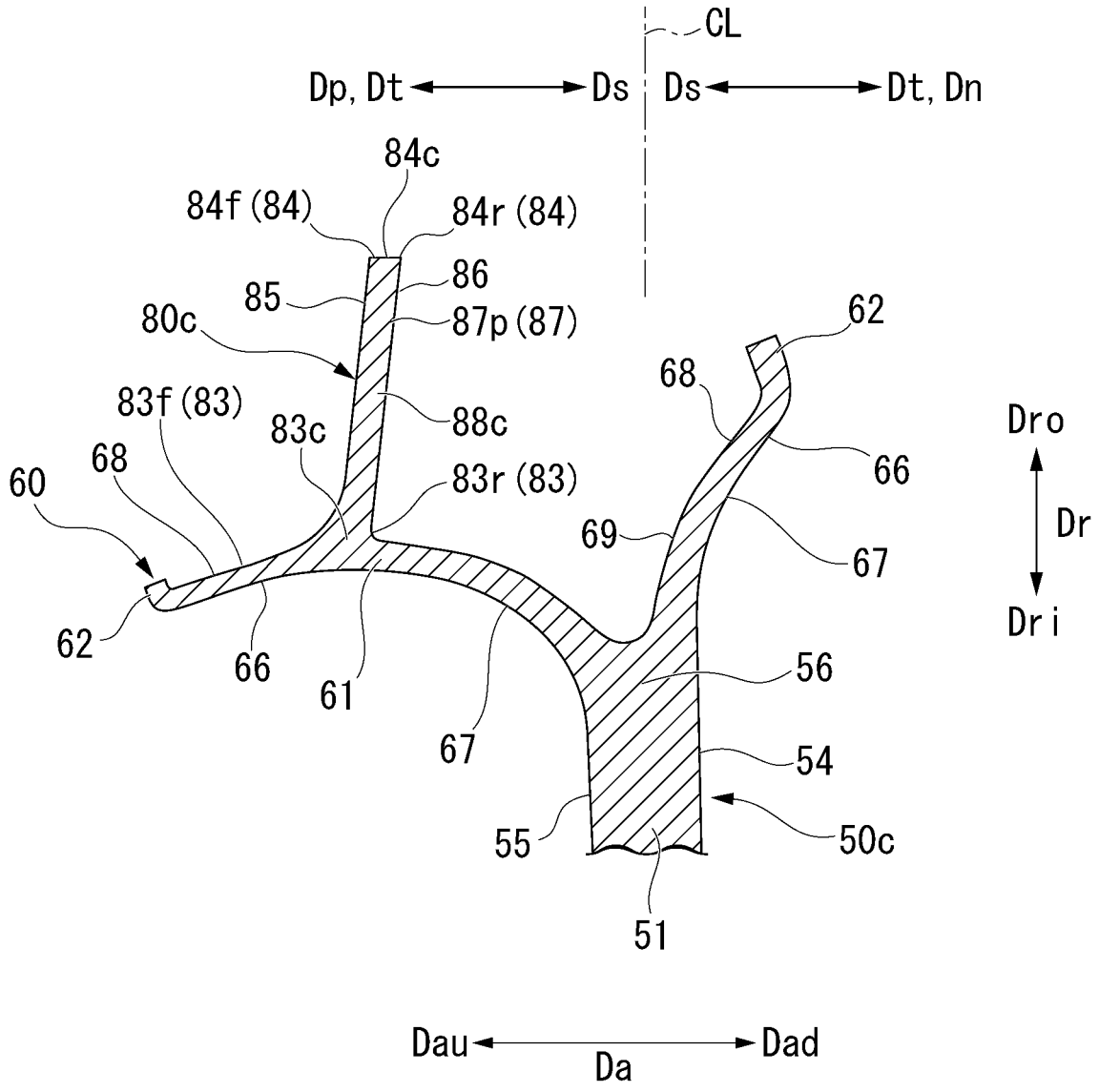
FIG. 11 is a cross-sectional view taken along a line XI-XI of FIG. 3 for a rotor blade according to a fourth embodiment of the present invention.
Figure 12:
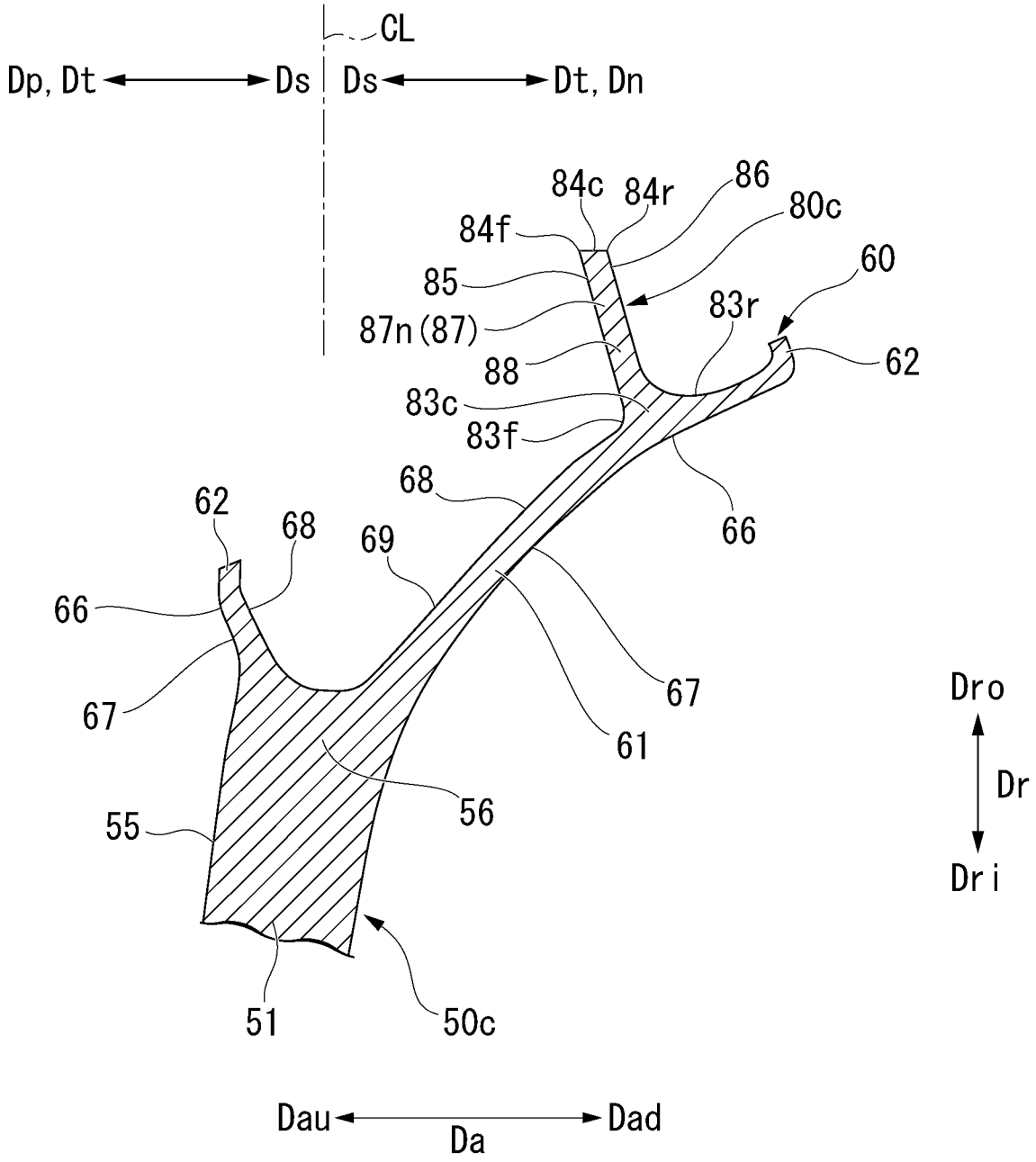
FIG. 12 is a cross-sectional view taken along a line XII-XII of FIG. 3 for the rotor blade according to the fourth embodiment of the present invention.

Referring to FIGS. 3, 11, and 12, a rotor blade according to a fourth embodiment of the present invention will be described.

As shown in FIGS. 11 and 12, the rotor blade 50*c* of the embodiment is a rotor blade obtained by changing the shape of the seal fin 80 of the rotor blade 50 of the first embodiment and the other configurations are the same as those of the rotor blade 50 of the first embodiment. Additionally, FIG. 11 is a cross-sectional view taken along a line XI-XI of FIG. 3 and FIG. 12 is a cross-sectional view taken along a line XII-XII of FIG. 3. Further, in the description of the rotor blade 50*c* of the embodiment, the seal fin 80 of the first embodiment is depicted in FIG. 3 for convenience of description since FIG. 3 showing the rotor blade 50 of the first embodiment is used. However, the shape of the seal fin 80*c* when the rotor blade 50*c* of the embodiment is viewed from the radially outward side Dro is different from the shape of the seal fin 80 shown in FIG. 3.

In the seal fin 80*c* of the embodiment, as shown in FIGS. 11 and 12, only the configuration of an inclined portion 88*c* of the shift portion 87 is different from the configuration of the seal fin 80 of the first embodiment. The inclined portion 88*c* of the embodiment also faces the axial direction Da as it goes toward the radially inward side Dri similarly to the inclined portion 88 of the first embodiment. However, in the inclined portion 88*c* of the embodiment, almost the entirety from the front end 84 to the base end 83 of the shift portion 87 forms an inclined portion. For this reason, the front surface 85 and the rear surface 86 of the shift portion 87 of the embodiment extend substantially linearly from the front end 84 to the base end 83.

As described above, the inclined portion of the shift portion 87 may be formed in a part from the front end 84 to the base end 83 in the shift portion 87 or may be formed in the substantially entirety from the front end 84 to the base end 83 in the shift portion 87.

Additionally, the embodiment is a modified example of the first embodiment, but the inclined portion of the shift portion 87 of the second embodiment may be also formed also almost entirely from the front end 84 to the base end 83 of the shift portion 87 similarly to the embodiment.

"Fifth embodiment of rotor blade"

Figure 13:
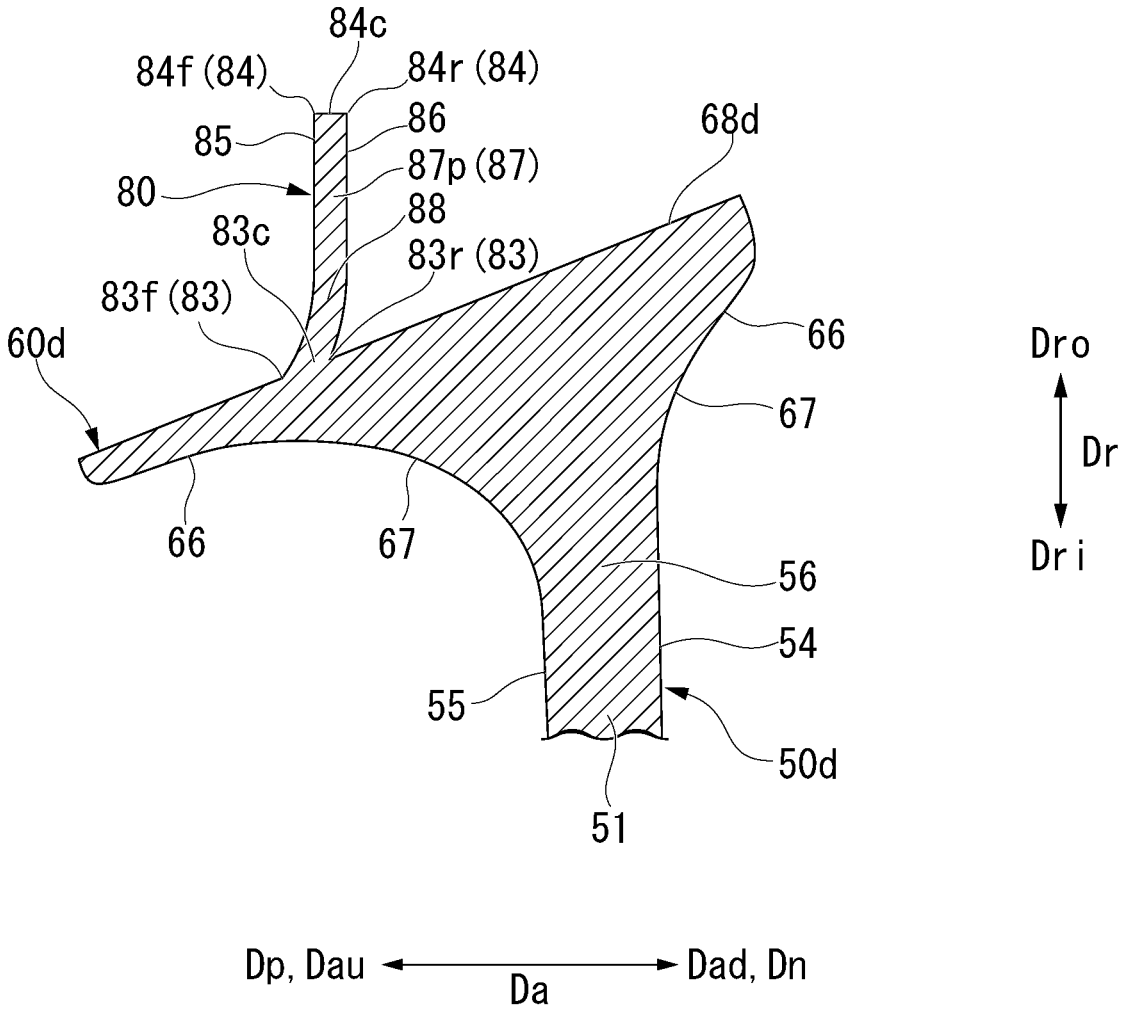
FIG. 13 is a cross-sectional view taken along a line XIII-XIII of FIG. 3 for a rotor blade according to a fifth embodiment of the present invention.
Figure 14:
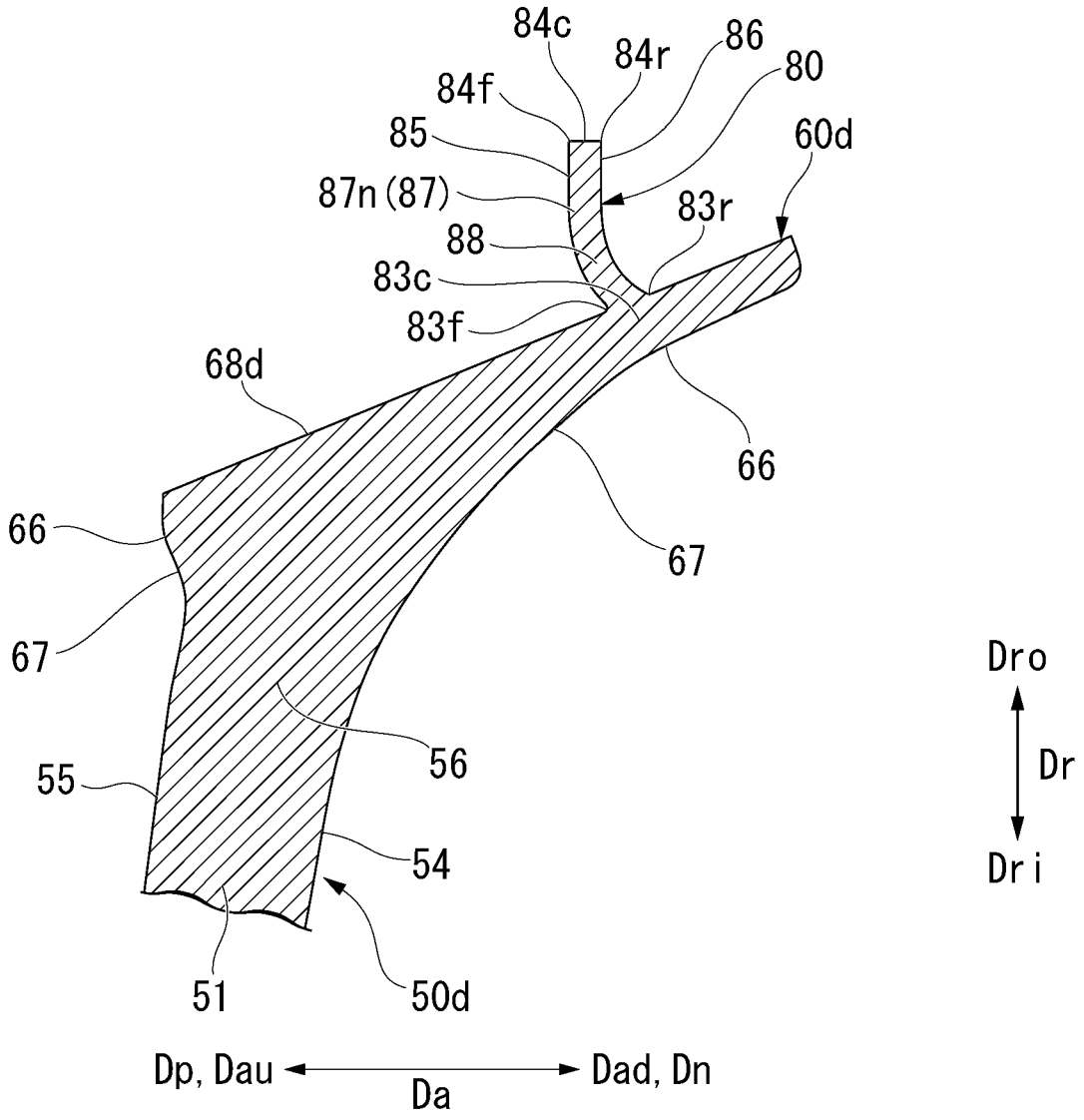
FIG. 14 is a cross-sectional view taken along a line XIV-XIV of FIG. 3 for the rotor blade according to the fifth embodiment of the present invention.

Referring to FIGS. 3, 13, and 14, a rotor blade according to a fifth embodiment of the present invention will be described.

As shown in FIGS. 13 and 14, the rotor blade 50*d* of the embodiment is a rotor blade obtained by changing the shape of the shroud cover 60 of the rotor blade 50 of the first embodiment and the other configurations are the same as those of the rotor blade 50 of the first embodiment. Additionally, FIG. 13 is a cross-sectional view taken along a line XIII-XIII of FIG. 3 and FIG. 14 is a cross-sectional view taken along a line XIV-XIV of FIG. 3.

The back surface 68 of the shroud cover 60 of each of the above-described embodiments includes a recessed surface which is recessed toward the radially inward side Dri. Meanwhile, the back surface 68*d* of the shroud cover 60*d* of the embodiment is a plane without a recessed surface.

As described above, the rotor blade 50*d* of the embodiment is a rotor blade obtained by changing the shape of the shroud cover 60 of the rotor blade 50 of the first embodiment and the other configurations are the same as those of the rotor blade 50 of the first embodiment. Thus, the seal fin 80 of the embodiment also includes the shift portion 87 similarly to the seal fin 80 of the first embodiment. Thus, also in the embodiment, it is possible to suppress the deformation of the shroud cover 60*d* while suppressing an increase in weight of the shroud similarly to the first embodiment.

Additionally, the embodiment is a modified example of the first embodiment, but the shroud covers of the second to fourth embodiments may be also have the same shape as that of the embodiment.

OTHER MODIFIED EXAMPLES

Figure 15:
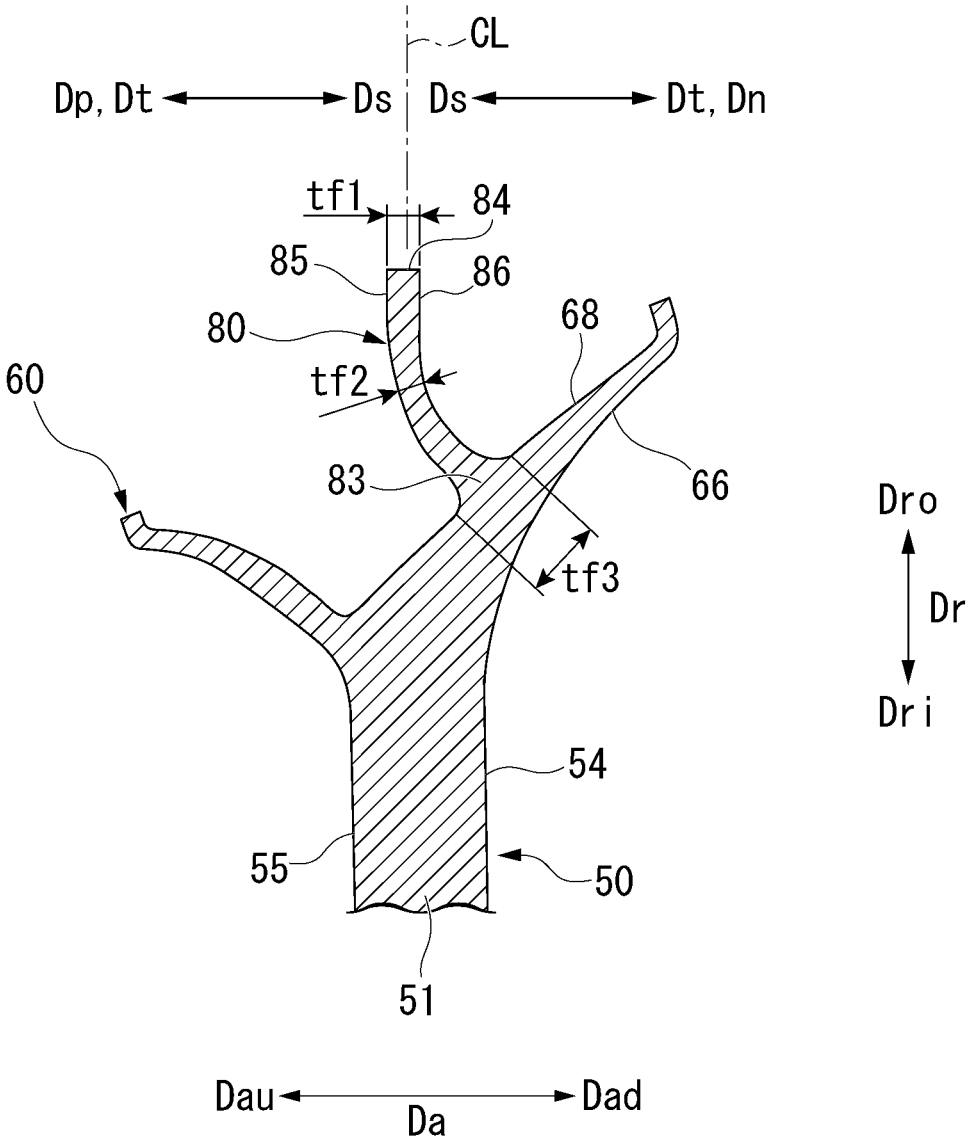
FIG. 15 is a cross-sectional view of a rotor blade according to a modified example of each embodiment of the present invention.

In the seal fin 80 shown in FIG. 5, the thickness of the front end 84 is substantially the same as the thickness of the intermediate portion between the front end 84 and the base end 83. Further, the thickness of the base end 83 is thicker than the thickness of the front end 84 and the thickness of the intermediate portion. However, as shown in FIG. 15, the thickness tf1 of the front end 84 and the thickness tf3 of the base end 83 may be thicker than the thickness tf2 of the intermediate portion 89. In this way, it is possible to reduce the weight of the seal fin while increasing the rigidity of the base end 83 of the seal fin by thickening the thickness tf3 of the base end 83 as compared to the thickness tf2 of the intermediate portion 89. Further, the thickness tf2 of the intermediate portion 89 may be thicker than the thickness tf1 of the front end 84 and the thickness tf3 of the base end 83 may be thicker than the thickness tf2 of the intermediate portion 89. As described above, the thickness of the seal fin at each position in the radial direction Dr may be appropriately changed. Further, the thickness of the seal fin at each position in the radial direction Dr may be appropriately changed at each position in the circumferential direction Dc in the seal fin.

The rotor blade of the configuration of the above-described embodiments is the rotor blade of the gas turbine. However, the rotor blade of the configuration of the above-described embodiments is not limited to the rotor blade of the gas turbine, but may be another axial flow rotating machine, for example, a rotor blade of a steam turbine.

EXPLANATION OF REFERENCES

10 Gas turbine
11 Gas turbine rotor
14 Intermediate casing
15 Gas turbine casing
20 Compressor
21 Compressor rotor
22 Rotor shaft
23 Rotor blade row
25 Compressor casing
26 Stationary blade row
30 Combustor
40 Turbine
41 Turbine rotor
42 Rotor shaft
43 Rotor blade row
45 Turbine casing
46 Stationary blade row
50, 50*a*, 50*b*, 50*c*, 50*d* Rotor blade
51 Blade body
52 Leading edge
53 Trailing edge
54 Suction surface
55 Pressure surface

56*o* Outer end portion
56*i* Inner end portion
57 Shroud
58 Platform
59 Blade base
60, 60*d* Shroud cover
61 Cover main body
62 Outer edge portion
63 Main body end portion
64 Main body intermediate portion
65 Blade side portion
66 Gas path surface
67 Fillet surface
68, 68*d* Back surface
69 Recessed surface
71 First outer edge
72 Second outer edge
73 Contact surface
80, 80*a*, 80*b*, 80*c* Seal fin
81 First end portion
82 Second end portion
83 Base end
83*f* Forward base end
83*r* Backward base end
83*c* Center position (of base end)
84 Front end
84*f* Forward front end
84*r* Backward front end
84*c* Center position (of front end)
85 Front surface
86 Rear surface
87 Shift portion
87*p* Pressure side shift portion
87*f* Suction side shift portion
88, 88*c* Inclined portion
89 Intermediate portion
A Air
F Fuel
G Combustion gas
CL Camber line
Ar Axis
Da Axial direction
Dau Axial upstream side
Dad Axial downstream side
Dc Circumferential direction
Dcf Forward rotation side
Dcr Backward rotation side
Dr Radial direction
Dri Radial inside
Dro Radial outside
Dn Suction side
Dp Pressure side

What is claimed is:

1. A rotor blade attached to a rotor shaft about an axis, comprising:

a blade body which extends in a radial direction with respect to the axis and of which a cross-section orthogonal to the radial direction is formed in an airfoil shape; and a shroud which is formed in an end portion of the blade body on a radial outside with respect to the axis, wherein the shroud includes a shroud cover which extends in a direction having a direction component of a circumferential direction with respect to the axis from each of a pressure surface and a suction surface of the blade body and a seal fin which protrudes from the shroud cover toward the radially outward side and extends in a direction having a direction component of a circumferential direction, the shroud cover includes a gas path surface which faces a radial inside with respect to the axis, and a back surface which is opposite to the gas path surface and which faces a radial outside, the seal fin includes a base end which has a thickness in an axial direction, in which the axis extends, and intersects the back surface and a front end which has a thickness in the axial direction and is on the most radial outside, the front end extends in the circumferential direction and the base end extends in a direction having a direction component of the circumferential direction, a part of the seal fin in the circumferential direction constitutes a shift portion and a center position of the base end of the shift portion in the axial direction is different from a center position of the front end of the shift portion in the axial direction in the axial direction, the seal fin includes a front surface which faces an axial upstream side corresponding to a side where a leading edge exists with respect to a trailing edge of the blade body in the axial direction and a rear surface which faces an axial downstream side opposite to the axial upstream side in the axial direction, the front end includes a forward front end which is an end on the most radial outside in the front surface and a backward front end which is an end on the most radial outside in the rear surface, the base end includes a forward base end which intersects the back surface in the front surface and a backward base end which intersects the back surface in the rear surface, the forward base end of the shift portion is shifted toward one side of the axial upstream side and the axial downstream side with respect to the forward front end of the shift portion of the seal fin, and the backward base end of the shift portion is also shifted toward the one side with respect to the backward front end of the shift portion of the seal fin.

2. The rotor blade according to claim 1, wherein the shift portion of the seal fin includes an inclined portion which faces the axial direction as it goes toward the radially inward side.

3. The rotor blade according to claim 1, wherein a thickness of the front end in the axial direction and a thickness of the base end in the axial direction are thicker than a thickness of an intermediate portion between the front end and the base end of the seal fin in the axial direction.

4. The rotor blade according to claim 1, wherein the seal fin extends from a first outer edge corresponding to a part of an outer edge of the back surface to a second outer edge corresponding to another part of the outer edge of the back surface over a camber line of the blade body, and the seal fin includes a first end portion which protrudes from the first outer edge toward the radially outward side and a second end portion which protrudes from the second outer edge toward the radially outward side.

5. The rotor blade according to claim 4, wherein in the first end portion and the second end portion of the seal fin, a center position of the base end in the axial direction matches a center position of the front end in the axial direction.

6. The rotor blade according to claim 4, wherein the shift portion includes a pressure side shift portion and a suction side shift portion, the pressure side shift portion is located on a pressure side in which the pressure surface exists with respect to the camber line and the suction side shift portion is located on a suction side in which the suction surface exists with respect to the camber line, a center position of the base end of the pressure side shift portion in the axial direction is shifted toward the axial upstream side with respect to a center position of the front end of the pressure side shift portion in the axial direction, a center position of the base end of the suction side shift portion in the axial direction is shifted toward an axial downstream side with respect to a center position of the front end of the suction side shift portion in the axial direction, and the axial upstream side is a side where a leading edge exists with respect to a trailing edge of the blade body in the axial direction and the axial upstream side is a side opposite to the axial upstream side in the axial direction.

7. The rotor blade according to claim 4, wherein the gas path surface includes a fillet surface which gradually extends toward the radially outward side as it separates away from each of the pressure surface and the suction surface of the blade body in a cross-section orthogonal to the camber line, the back surface includes a recessed surface which extends so as to be recessed toward the radially inward side along the fillet surface in the cross-section, and a height of the seal fin in the radial direction is set such that the height of an intermediate portion between the first end portion and the second end portion is higher than the height of the first end portion and the height of the second end portion in the seal fin.

8. The rotor blade according to claim 1, wherein the gas path surface includes a fillet surface which gradually extends toward the radially outward side as it separates away from each of the pressure surface and the suction surface of the blade body in a cross-section orthogonal to a camber line of the blade body, and the back surface includes a recessed surface which extends so as to be recessed toward the radially inward side along the fillet surface in the cross-section.

9. The rotor blade according to claim 7, wherein the recessed surface extends toward both sides with respect to the camber line in the cross-section, and in the cross-section, a first surface on a pressure side in which the pressure surface exists with respect to the camber line in the recessed surface faces the radially inward side as it goes toward a suction side in which the suction surface exists with respect to the camber line, and a second surface on the suction side with respect to the camber line in the recessed surface faces the radially inward side as it goes toward the pressure side.

10. The rotor blade according to claim 8, wherein the recessed surface extends toward both sides with respect to the camber line in the cross-section, and in the cross-section, a first surface on a pressure side in which the pressure surface exists with respect to the camber line in the recessed surface faces the radially inward side as it goes toward a suction side in which the suction surface exists with respect to the camber line, and a second surface on the suction side with respect to the camber line in the recessed surface faces the radially inward side as it goes toward the pressure side.

11. An axial flow rotating machine comprising:

the plurality of rotor blades according to claim 1;

the rotor shaft; and a casing, wherein the plurality of rotor blades are arranged in the circumferential direction and are attached to the rotor shaft, and the casing covers an outer peripheral side of the rotor shaft and the plurality of rotor blades.

* * * * *